US005340707A

United States Patent [19]

Ohnishi et al.

[11] Patent Number: 5,340,707

[45] Date of Patent: Aug. 23, 1994

[54] SILVER HALIDE PHOTOGRAPHIC LIGHT-SENSITIVE MATERIAL

[75] Inventors: Akira Ohnishi; Yasushi Usagawa; Taketoshi Yamada, all of Hino, Japan

[73] Assignee: Konica Corporation, Tokyo, Japan

[21] Appl. No.: 120,409

[22] Filed: Sep. 14, 1993

[30] Foreign Application Priority Data

Sep. 16, 1992 [JP] Japan ..... 4-246867

[51] Int. Cl.[5] ..... G03C 1/06

[52] U.S. Cl. ..... 430/522; 430/517

[58] Field of Search ..... 430/522, 517, 510, 591, 430/597

[56] References Cited

U.S. PATENT DOCUMENTS 1,845,404 2/1932 Durr et al. .
2,493,747 1/1950 Brooker et al. .
2,538,008 1/1951 Keyes et al. .
4,067,872 1/1978 Bloom .
4,420,555 12/1983 Krueger et al. .
4,857,446 8/1989 Diehl et al. .

*Primary Examiner*—Jack P. Brammer
*Attorney, Agent, or Firm*—Finnegan, Henderson, Farabow, Garrett & Dunner

[57] ABSTRACT

A silver halide photographic light-sensitive material containing a dye is disclosed. The dye is represented by a formula wherein $R_1$ represents a hydrogen atom, an alkyl group, an aryl group or a heterocyclic group; $R_2$ represents a hydrogen atom, an alkyl group, an aryl group, a heterocyclic group, an alkoxycarbonyl group, an aryloxycarbonyl group, a carbamoyl group, an acylamino group, an ureide group, an amino group, an acyl group, an alkoxy group, an aryloxy group, a hydroxyl group, a carboxyl group, a cyano group, a sulfamoyl group or a sulfonamide group; B represents a 5- or 6-membered oxygen-containing heterocyclic group or a 6-membered nitrogen-containing heterocyclic group; $L_1$ through $L_3$ independently represent a methine group; n represents 0 or 1. The compound of formula 1 has at least one carboxyl group, sulfonamide group or sulfamoyl group.

9 Claims, No Drawings

SILVER HALIDE PHOTOGRAPHIC LIGHT-SENSITIVE MATERIAL

FIELD OF THE INVENTION

The present invention relates to a silver halide photographic light-sensitive material containing a dye, more specifically a silver halide photographic light-sensitive material containing a new dye wherein the degrees of fogging and sensitivity loss over time are low even when a particular layer is dyed with the dye.

BACKGROUND OF THE INVENTION

Silver halide photographic light-sensitive materials are required to offer high image quality properties such as excellent sharpness and color reproducibility.

It is a common practice to incorporate a dye in a silver halide photographic light-sensitive material to improve image quality or to adjust silver halide emulsion sensitivity. For example, dyes are used in anti-halation layers, anti-irradiation layers and light absorbing filters.

In recent years, there have been increasing photographic applications of dyes, including dyes used to substitute for yellow colloidal silver (hereinafter referred to as YC dyes) in color photographic light-sensitive materials, dyes used to dye crossover cut layers in radiographic light-sensitive materials, and dyes used to dye non-light-sensitive layers in photographic light-sensitive materials for graphic arts.

Dyes used for these purposes are required to meet various requirements, depending on the purpose of their use, including the following:

1) Have a good absorption spectrum.
2) Do not diffuse from the colored layer to another layer.
3) Do not photographically affect the light-sensitive silver halide emulsion.
4) Stable in the silver halide photographic light-sensitive material.
5) Easy to add.
6) Stable in the emulsion coating solution, having no effect on solution viscosity.
7) Do not leave color after processing.

To meet these requirements, a large number of dyes have been proposed, including azo dyes, the oxonol dyes disclosed in British Patent No. 506,385 and Japanese Patent Examined Publication No. 22069/1964, the merocyanine dyes disclosed in U.S. Pat. No. 2,493,747 and the styryl dyes disclosed in U.S. Pat. No. 1,845,404.

Dyes whose diffusibility has been suppressed to allow dyeing a particular layer are known, including non-diffusible YC dyes such as those disclosed in U.S. Pat. Nos. 2,538,008, 2,539,009 and 4,420,555, Japanese Patent Publication Open to Public Inspection (hereinafter referred to as Japanese Patent O.P.I. Publication) Nos. 204630/1986, 205934/1986, 32460/1987, 56958/1987, 92949/1987, 222248/1987, 40143/1988, 184749/1988 and 316852/1988. As means of suppressing dye diffusibility, methods of dyeing a particular layer with a solid dispersion of dye are described in Japanese Patent O.P.I. Publication Nos. 120030/1980, 155350/1980, 155351/1980, 12639/1981, 27838/1988 and 197943/1988 and PCT-WO-88/04794. However, these dyes show residual color staining after ultra-rapid processing, requiring further improvement.

There is a need for a new non-diffusible dye which has improved storage stability, which prevents sensitivity loss over time and which suppresses residual color staining by improvement of bleacheability.

SUMMARY OF THE INVENTION

It is an object of the present invention to provide a silver halide photographic light-sensitive material of reduced fogging and improved storage stability meeting the above-described requirements for a non-diffusible dye. It is another object of the invention to provide a silver halide photographic light-sensitive material of high sensitivity and excellent sharpness. It is still another object of the invention to provide a silver halide photographic light-sensitive material which offers an image of reduced color staining even in quick processing. It is yet another object of the invention to provide a crossover-free silver halide radiographic light-sensitive material of high sharpness. It is still yet another object of the invention to provide a silver halide photographic light-sensitive material for graphic arts of good dot quality and excellent line image reproducibility.

A silver halide photographic light-sensitive material of the present invention having a layer containing a solid particle dispersion of a compound of the formula:

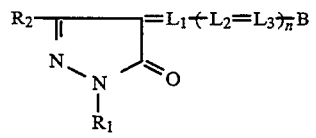

I wherein $R_1$ is a hydrogen atom, an alkyl group, an aryl group or a heterocyclic group; $R_2$ is a hydrogen atom, an alkyl group, an aryl group, a heterocyclic group, an alkoxycarbonyl group, an aryloxycarbonyl group, a carbamoyl group, an acylamino group, an ureide group, an amino group, an acyl group, an alkoxy group, an aryloxy group, a hydroxyl group, a carboxyl group, a cyano group, a sulfamoyl group or a sulfonamide group; B is a 5- or 6-membered oxygen-containing heterocyclic group or a 6-membered nitrogen-containing heterocyclic group; $L_1$ through $L_3$ independently represent a methine group; n represents 0 or 1. The compound of the formula has at least one carboxyl group, sulfonamide group or sulfamoyl group.

DETAILED DESCRIPTION OF THE INVENTION

Examples of the alkyl group represented by $R_1$ or $R_2$ above include a methyl group, an ethyl group, a propyl group, an isopropyl group, a t-butyl group, a pentyl group, a hexyl group, an octyl group, a 2-ethylhexyl group, a dodecyl group, a pentadecyl group and an eicosyl group. These alkyl groups include those having a substituent. The substituent is exemplified by halogen atoms such as atoms of chlorine, bromine, iodine and fluorine, aryl groups such as a phenyl group and a naphthyl group, cycloalkyl groups such as a cyclopentyl group and a cyclohexyl group, heterocyclic groups such as a pyrrolidyl group, a pyridyl group, a furyl group and a thienyl group, a sulfinic acid group, a carboxyl group, a sulfo group, a nitro group, a hydroxyl group, a mercapto group, amino groups such as an amino group and a diethylamino group, alkoxy groups such as a methoxy group, an ethoxy group, an n-butoxy group, an n-octyloxy group and an isopropoxy group, aryloxy groups such as a phenyloxy group and a naphthyloxy group, carbamoyl groups such as an aminocarbonyl group, a methylcarbamoyl group, an n-pentylcarbamoyl group and a phenylcarbamoyl group, amide groups such as a methylamide group, a benzamide group and an n-octylamide group, aminosulfonylamino groups such as an aminosulfonylamino group, a methylaminosulfonylamino group and an anilinosulfonylamino group, sulfamoyl groups such as a sulfamoyl group, a methylsulfamoyl group, a phenylsulfamoyl group and an n-butylsulfamoyl group, sulfonamide groups such as a methanesulfonamide group, an n-heptanesulfonamide group and a benzenesulfonamide group, sulfinyl groups (e.g., alkylsulfinyl groups such as a methylsulfinyl group, an ethylsulfinyl group and an octylsulfinyl group, and arylsulfinyl groups such as a phenylsulfinyl group), alkoxycarbonyl groups such as a methoxycarbonyl group, an ethoxycarbonyl group, a 2-hydroxyethyloxycarbonyl group and an n-octyloxycarbonyl group, aryloxycarbonyl groups such as a phenyloxycarbonyl group and a naphthyloxycarbonyl group, alkylthio groups such as a methylthio group, an ethylthio group and an n-hexylthio group, arylthio groups such as a phenylthio group and a naphthylthio group, alkylcarbonyl groups such as an acetyl group, an ethylcarbonyl group, an n-butylcarbonyl group and an n-octylcarbonyl group, arylcarbonyl groups such as a benzoyl group, a p-methanesulfonamidobenzoyl group, a p-carboxybenzoyl group and a naphthoyl group, a cyano group, ureide groups such as a methylureide group and a phenylureide group, and thioureide groups such as a methylthioureide group and a phenylthioureide group.

Examples of the aryl group represented by $R_1$ or $R_2$include a phenyl group and a naphthyl group. These aryl groups include those having a substituent. The substituent is exemplified by the above-mentioned alkyl groups and the same groups as specified above as substituents for the alkyl groups.

The heterocyclic group represented by $R_1$ or $R_2$ is exemplified by pyridyl groups such as a 2-pyridyl group, a 3-pyridyl group, a 4-pyridyl group, a 5-carboxy-2-pyridyl group, a 3,5-dichloro-2-pyridyl group, a 4,6-dimethyl-2-pyridyl group, a 6-hydroxy-2-pyridyl group, a 2,3,5,6-tetrafluoro-4-pyridyl group and a 3-nitro-2-pyridyl group, oxazolyl groups such as a 5-carboxy-2-benzoxazolyl group, a 2-benzoxazolyl group and a 2-oxazolyl group, thiazolyl groups such as a 5-sulfamoyl-2-benzothiazolyl group, a 2-benzothiazolyl group and a 2-thiazolyl group, imidazolyl groups such as a 1-methyl-2-imidazolyl group and a 1-methyl-5-carboxy-2-benzimidazolyl group, furyl groups such as a 3-furyl group, pyrrolyl groups such as a 3-pyrrolyl group, thienyl groups such as a 2-thienyl group, pyrazinyl groups such as a 2-pyrazinyl group, pyrimidinyl groups such as a 2-pyrimidinyl group and a 4-chloro-2-pyrimidinyl group, pyridazinyl groups such as a 2-pyridazinyl group, purinyl groups such as an 8-purinyl group, isoxazolyl groups such as a 3-isoxazolyl group, selenazolyl groups such as a 5-carboxy-2-selenazolyl group, sulfolanyl groups such as a 3-sulfolanyl group, piperidinyl groups such as a 1-methyl-3-piperidinyl group, pyrazolyl groups such as a 3-pyrazolyl group and tetrazolyl groups such as a 1-methyl-5-tetrazolyl group. These heterocyclic groups include those having a substituent. The substituent is exemplified by the above-mentioned alkyl groups and the same groups as specified above as substituents for the alkyl groups.

The alkoxycarbonyl group represented by $R_2$ is exemplified by a methoxycarbonyl group, an ethoxycarbonyl group, an isopropoxycarbonyl group, a t-butoxycarbonyl group, a pentyloxycarbonyl group and a dodecyloxycarbonyl group.

The aryloxycarbonyl group represented by $R_2$ is exemplified by a phenyloxycarbonyl group and a naphthyloxycarbonyl group.

The carbamoyl group represented by $R_2$ is exemplified by an aminocarbonyl group, a methylcarbamoyl group, an ethylcarbamoyl group, an isopropylcarbamoyl group, a t-butylcarbamoyl group, a dodecylcarbamoyl group, a phenylcarbamoyl group, a 2-pyridylcarbamoyl group, a 4-pyridylcarbamoyl group, a benzylcarbamoyl group, a morpholinocarbamoyl group and a piperazinocarbamoyl group.

The sulfamoyl group represented by $R_2$ is exemplified by an aminosulfonyl group, a methylsulfamoyl group, an isopropylsulfamoyl group, a t-butylsulfamoyl group, a dodecylsulfamoyl group, a phenylsulfamoyl group, a 2-pyridylsulfamoyl group, a 4-pyridylsulfamoyl group, a morpholinosulfamoyl group and a piperazinosulfamoyl group.

The sulfonamide group represented by $R_2$ is exemplified by a methylsulfonamide group, an ethylsulfonamide group, an isopropylsulfonamide group, a t-butylsulfonamide group, a dodecylsulfonamide group, a phenylsulfonamide group and a naphthylsulfonamide group.

The acylamino group represented by $R_2$ is exemplified by a methylcarbonylamino group, an ethylcarbonylamino group, an isopropylcarbonylamino group, a t-butylcarbonylamino group, a dodecylcarbonylamino group, a phenylcarbonylamino group and a naphthylcarbonylamino group.

The ureide group represented by $R_2$ is exemplified by a methylureide group, an ethylureide group, an isopropylureide group, a t-butylureide group, a dodecylureide group, a phenylureide group, a 2-pyridylureide group and a thiazolylureide group.

The amino group represented by $R_2$ is exemplified by an amino group, a methylamino group, an ethylamino group, an isopropylamino group, a t-butylamino group, an octylamino group, a dodecylamino group, a dimethylamino group, an anilino group, a naphthylamino group, a morpholino group and a piperazino group.

The acyl group represented by $R_2$ is exemplified by a methylcarbonyl group, an ethylcarbonyl group, an isopropylcarbonyl group, a t-butylcarbonyl group, an octylcarbonyl group, a dodecylcarbonyl group, a phenylcarbonyl group and a naphthylcarbonyl group.

The alkoxy group represented by $R_2$ is exemplified by a methoxy group, an ethoxy group, an isopropoxy group, a t-butyloxy group and a dodecyloxy group.

The aryloxy group represented by $R_2$ is exemplified by a phenoxy group and a naphthyloxy group.

These groups include those having a substituent. The substituent is exemplified by the above-mentioned alkyl groups for $R_1$ and $R_2$ and the same groups as specified above as substituents for the alkyl groups for R]and $R_2$.

With respect to formula I, the 5- or 6-membered oxygen-containing heterocyclic group or 6-membered nitrogen-containing heterocyclic group represented by B is exemplified by furyl groups such as a 2-furyl group, a 3-furyl group, a 2-benzofuranyl group, and a 3-benzofuranyl group, pyranyl groups such as a 2-tetrahydropyranyl group, a 3-2H-pyranyl group, a 4-2H-pyranyl group, a 5-2H-pyranyl group, a 6-2H-pyranyl group, a 2-4H-pyranyl group, a 3-4H-pyranyl group, a 2-chromanyl group, a 3-chromanyl group, a 4-2H-chromenyl group and a 2-4H-chromenyl group, pyronyl groups such as a 2-4H-pyronyl group, a 3-4H-pyronyl group, a 2-chromonyl group, a 3-coumarinyl group and a 3-chromonyl group, pyridyl groups such as a 2-pyridyl group, a 3-pyridyl group, a 4-pyridyl group, a 2-quinolyl group, a 3-quinolyl group, a 4-quinolyl group, a 9-acridinyl group and a 3-thienopyridyl group, pyrazinyl groups such as a 2-pyrazinyl group, pyrimidinyl groups such as a 2-pyrimidinyl group, a 4-pyrimidinyl group, a 5-pyrimidinyl group and a 2-quinazolinyl group, and piperidinyl groups such as a 3-piperidinyl group. These heterocyclic groups include those having a substituent. The substituent is exemplified by the above-mentioned alkyl groups for $R_1$ and $R_2$, the same groups as specified above as substituents for the alkyl groups, and the same amino groups, alkoxy groups and aryloxy groups as specified above for $R_2$.

With respect to formula I, the methine groups represented by $L_1$ through $L_3$ include those having a substituent. The substituent is exemplified by alkyl groups such as a methyl group, an ethyl group, an isopropyl group, a t-butyl group, a 3-hydroxypropyl group and a benzyl group, aryl groups such as a phenyl group, halogen atoms such as those of chlorine, bromine, iodine and fluorine, alkoxy groups such as a methoxy group and an ethoxy group and acyloxy groups such as a methylcarbonyloxy group and a phenylcarbonyloxy group.

Preferable compound of the invention is represented by the formula II:

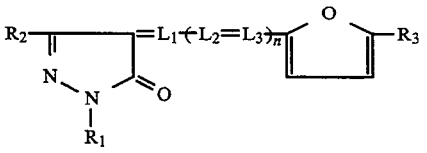

II wherein $R_1$, $R_2$, $L_1$, $L_2$, $L_3$ and n are the same as mentioned above. The compound of the Formula II has a carboxyl group, sulfonamide group or sulfamoyl group.

$R_3$ is an alkyl group, an aryl group, a heterocyclic group, an alkoxycarbonyl group, an aryloxycarbonyl group, a carbamoyl group, an acylamino group, an ureide group, an amino group, an acyl group, an alkoxy group, an aryloxy group, a hydroxyl group, a carboxyl group, a cyano group, a sulfamoyl group or a sulfonamide group. The preferable examples are

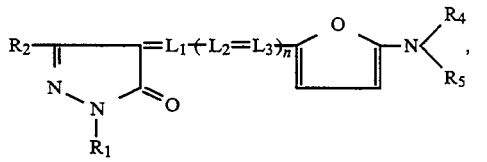

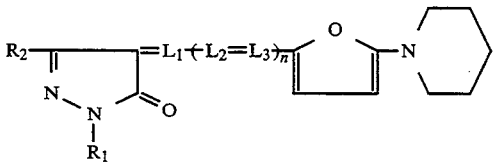

and

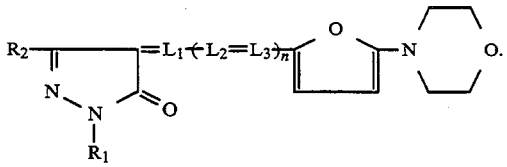

$R_1$, $R_2$, $L_1$, $L_2$, $L_3$ and n are the same as mentioned above and $R_4$ and $R_5$ are a lower alkyl group having 1 to 4 carbon atoms. Each compound has a carboxyl group, sulfonamide group or sulfamoyl group. The preferable is a carboxyl group of these groups. A preferable group for $R_2$ is an alkyl, aryl, alkoxycarbonyl, carboxyl carbamoyl, acyl or cyano group.

Examples of the compound of formula I are given below.

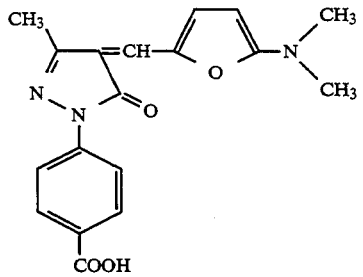

(1)

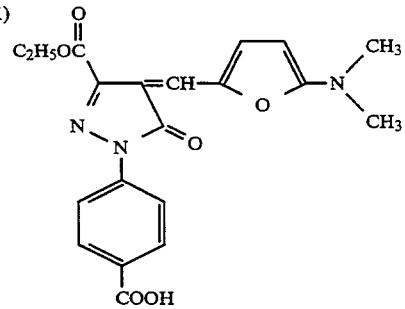

(2)

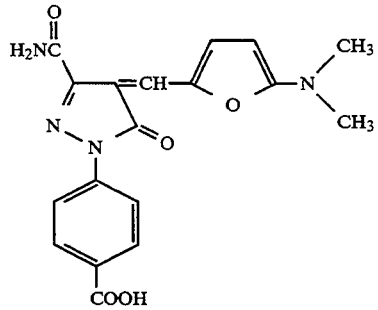

(3)

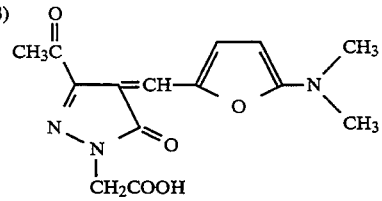

(4)

-continued
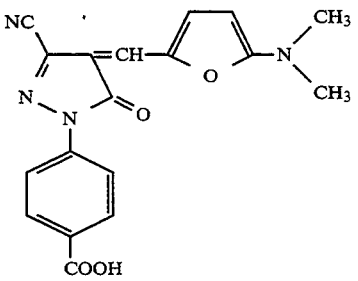
(5)
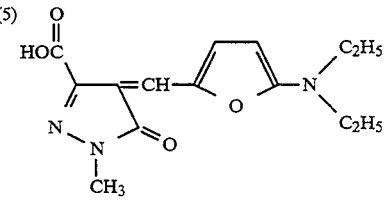
(6)
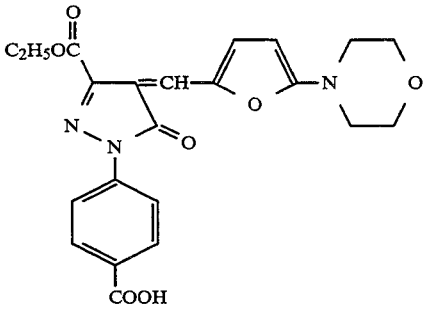
(7)
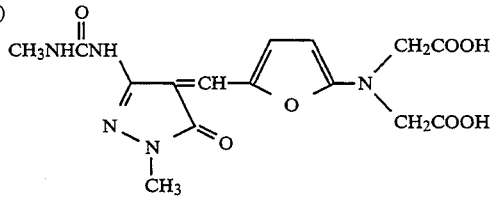
(8)
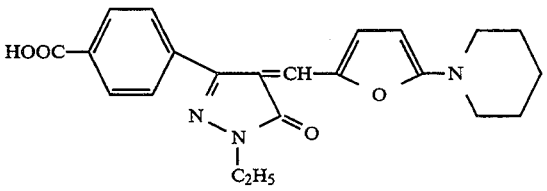
(9)
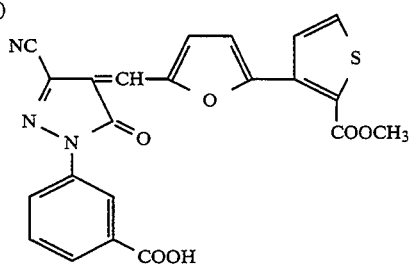
(10)
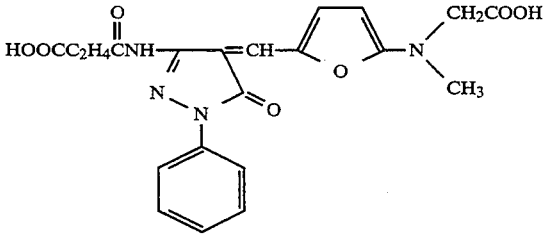
(11)
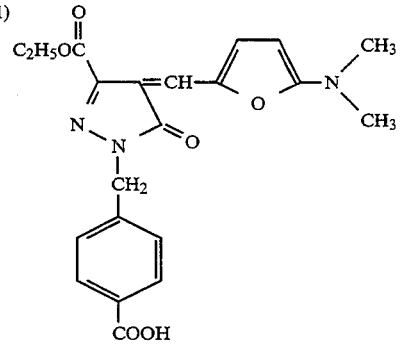
(12)
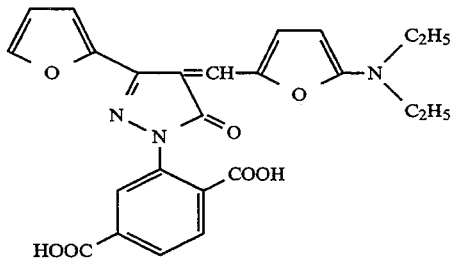
(13)
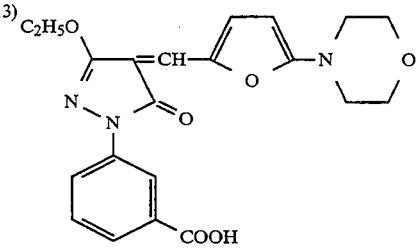
(14)

-continued
(15)
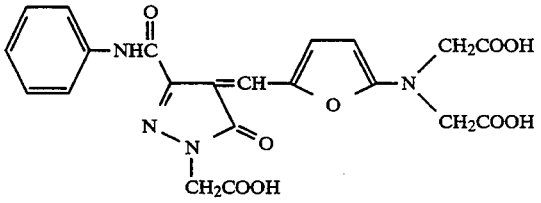
(16)
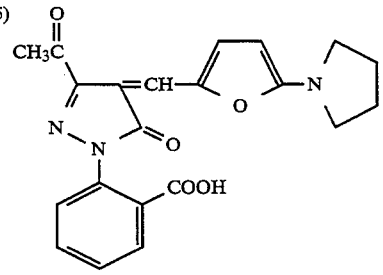
(17)
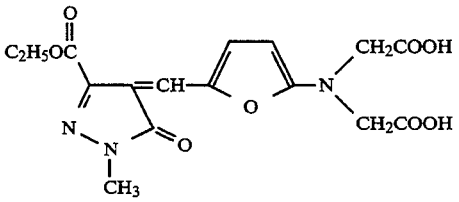
(18)
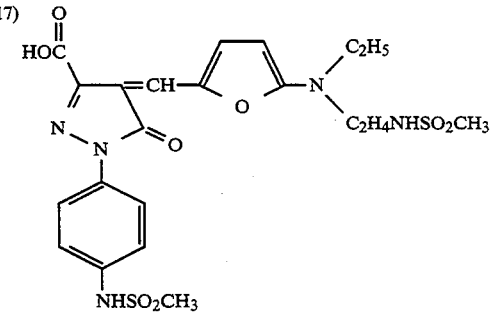
(19)
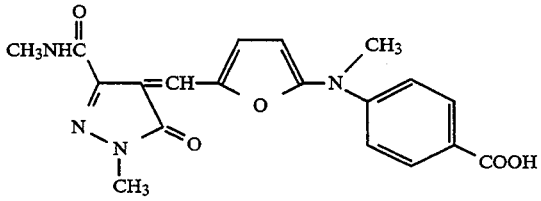
(20)
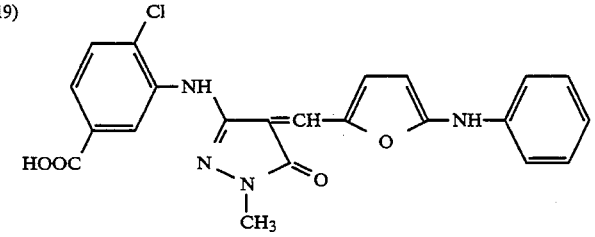
(21)
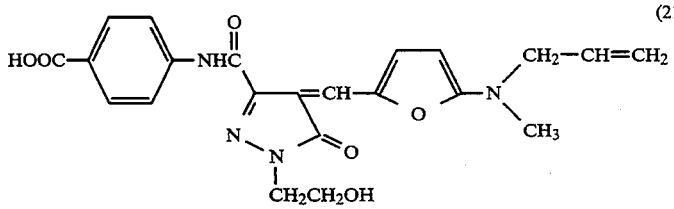
(22)
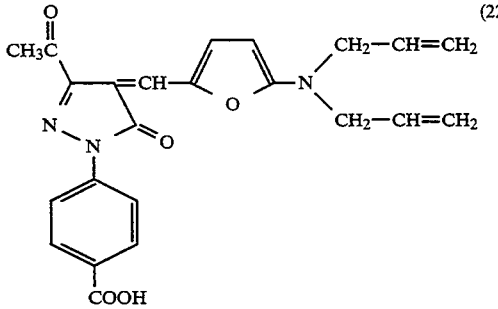
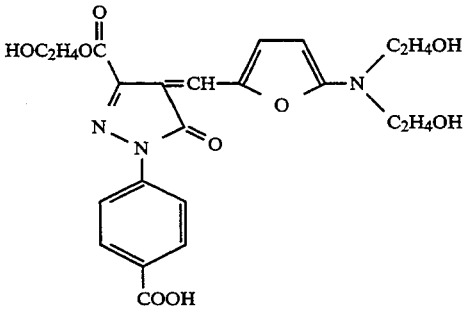
(23)
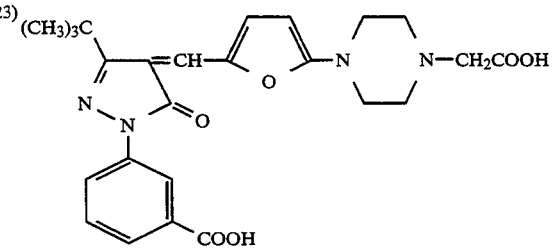
(24)
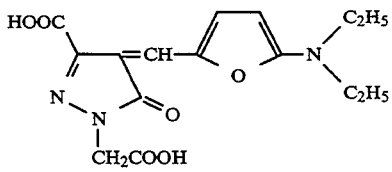
(25)
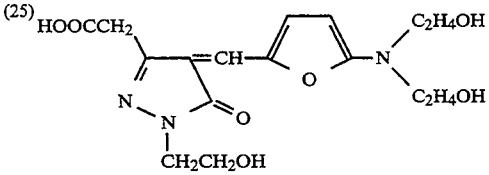
(26)

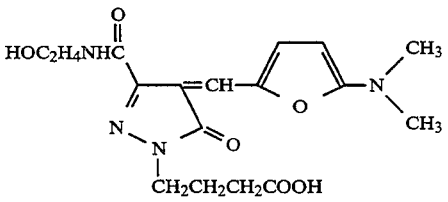
-continued
(27)
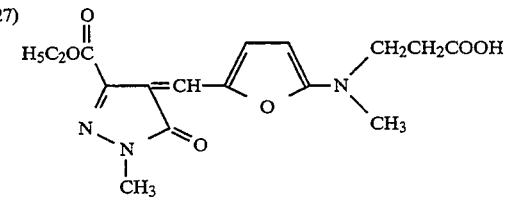
(28)
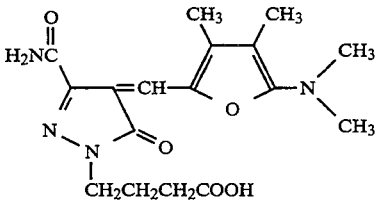
(29)
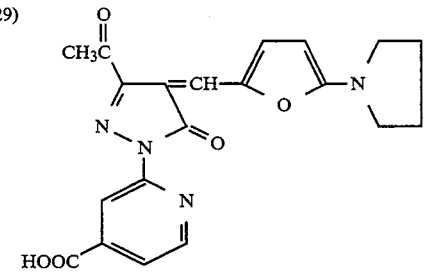
(30)
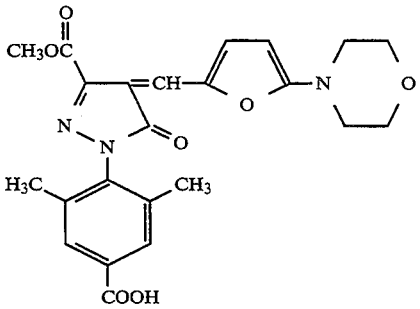
(31)
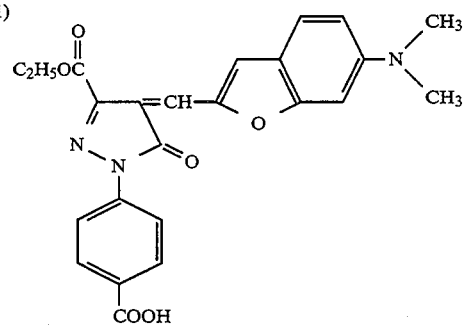
(32)
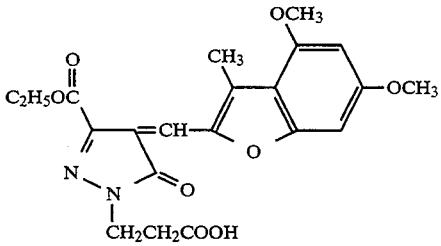
(33)
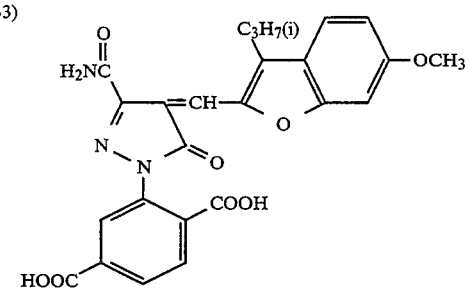
(34)
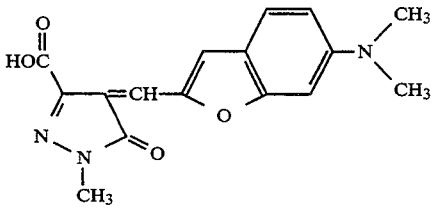
(35)
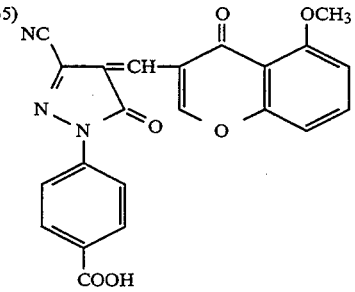
(36)
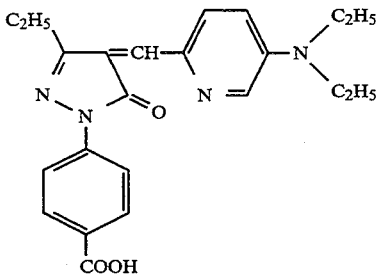
(37)
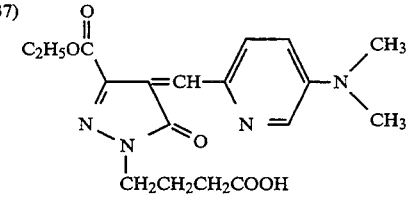
(38)

-continued
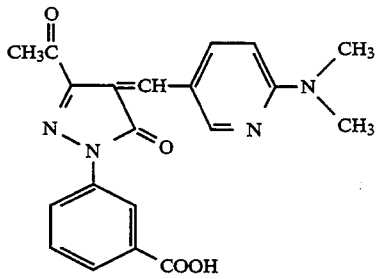
(39)
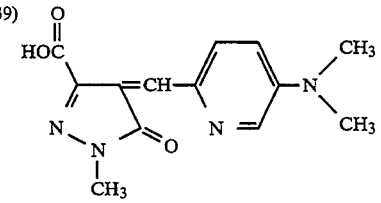
(40)
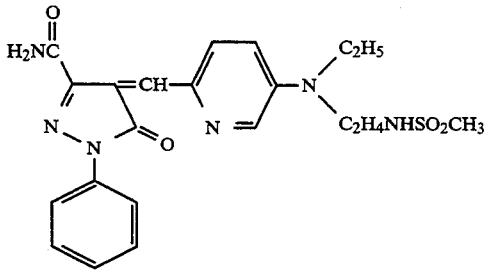
(41)
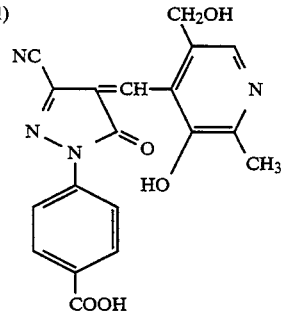
(42)
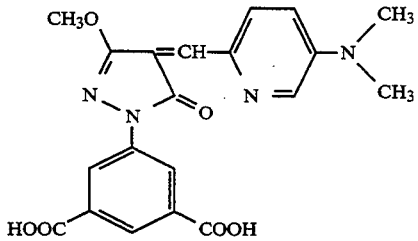
(43)
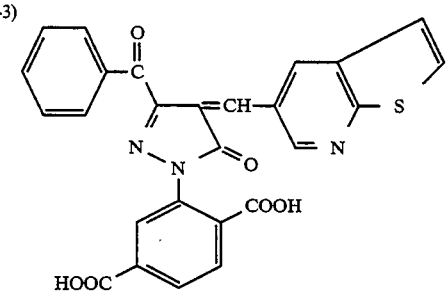
(44)
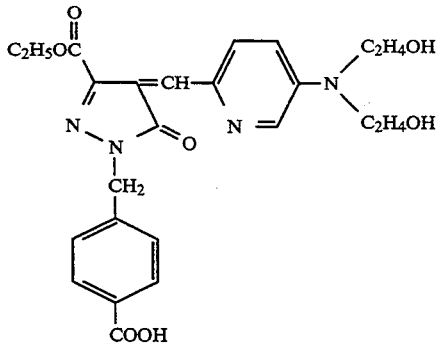
(45)
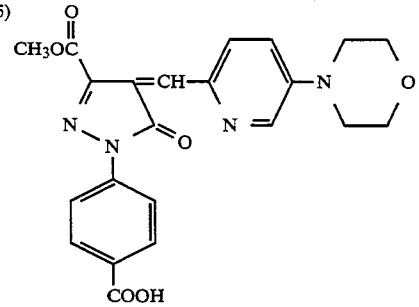
(46)
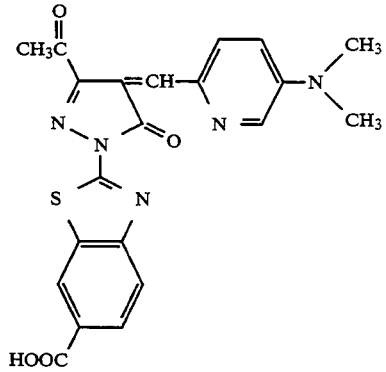
(47)
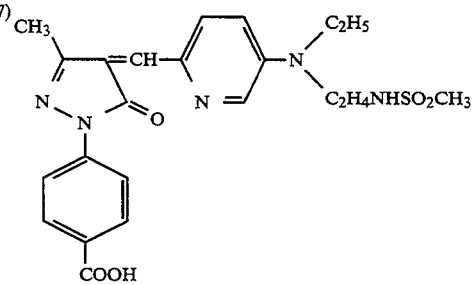
(48)

-continued
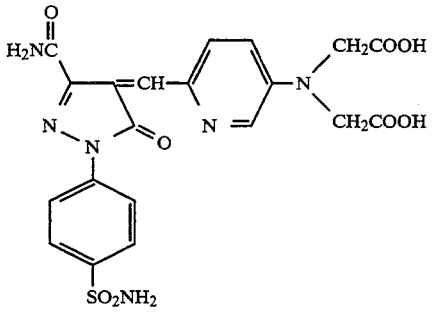
(49)
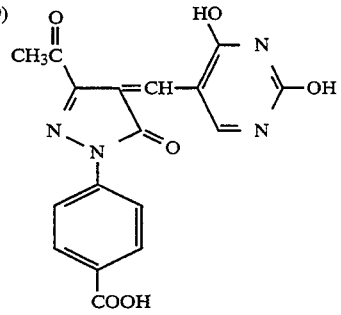
(50)
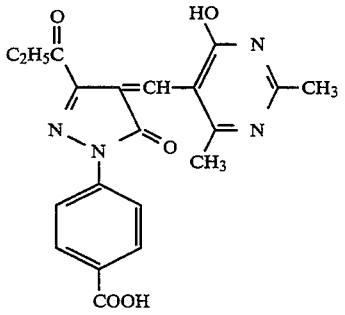
(51)
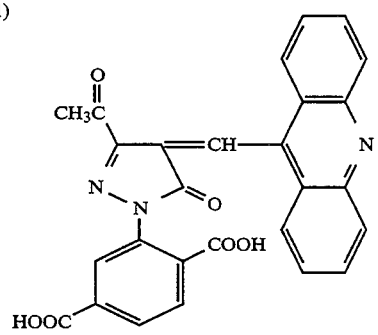
(52)
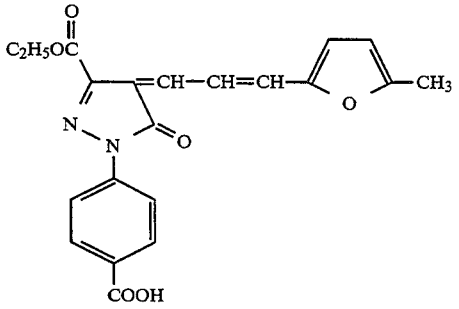
(53)
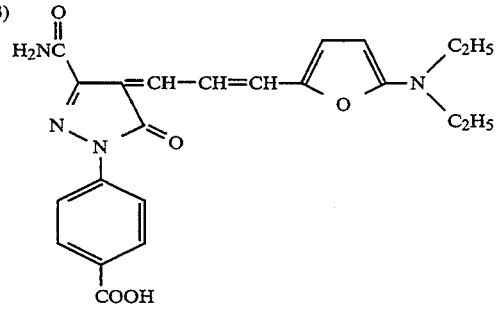
(54)
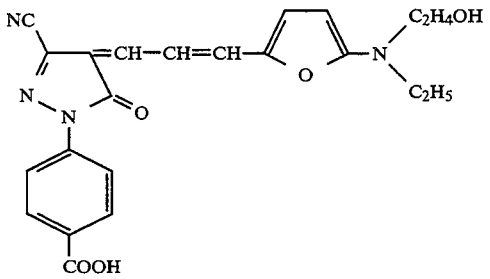
(55)
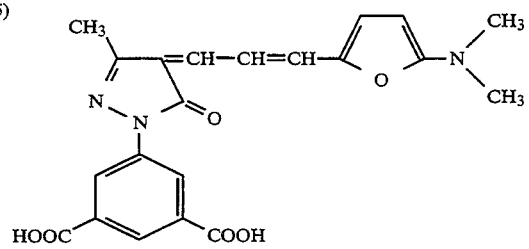
(56)
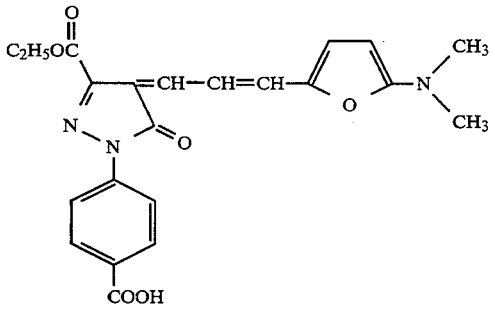
(57)
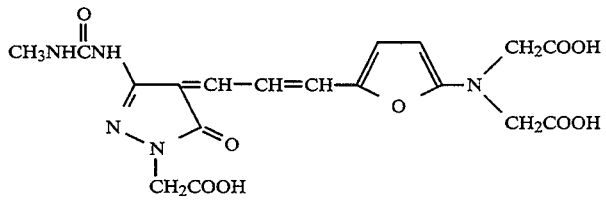
(58)

-continued
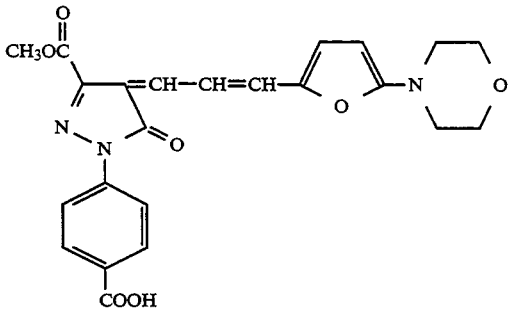
(59)
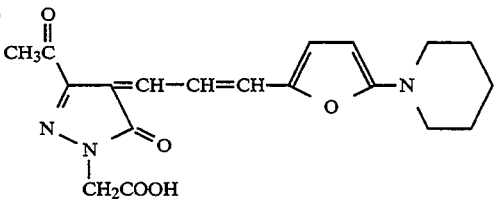
(60)
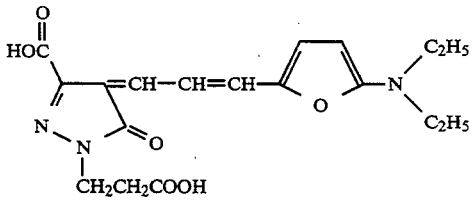
(61)
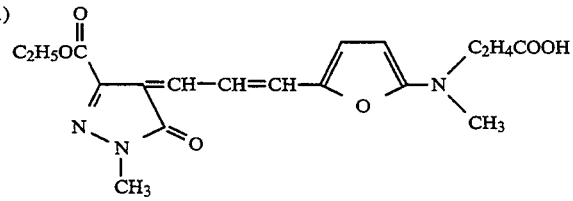
(62)
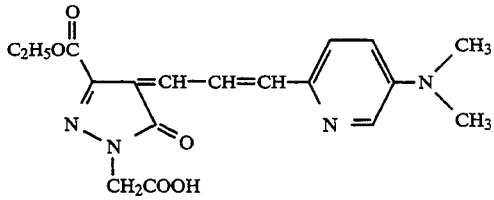
(63)
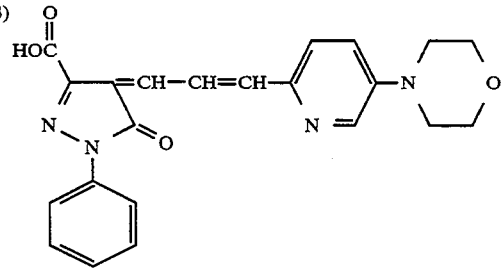
(64)
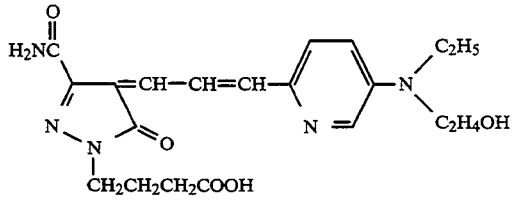
(65)
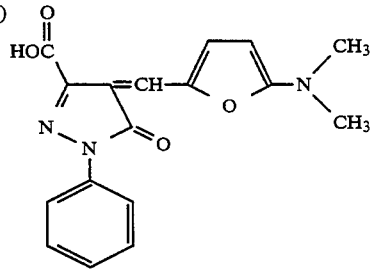
(66)
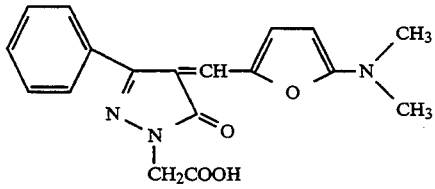
(67)
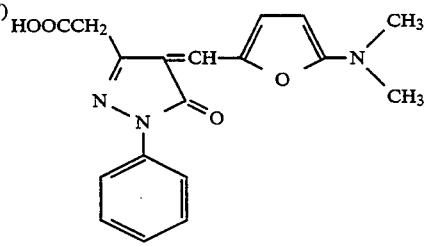
(68)
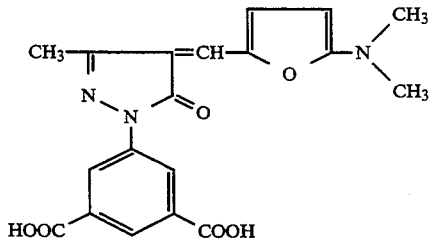
(69)
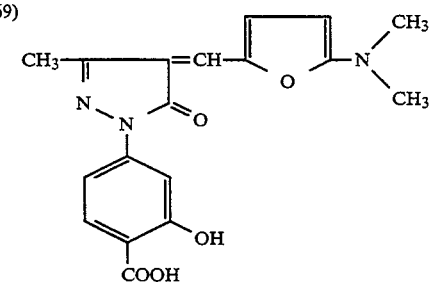
(70)

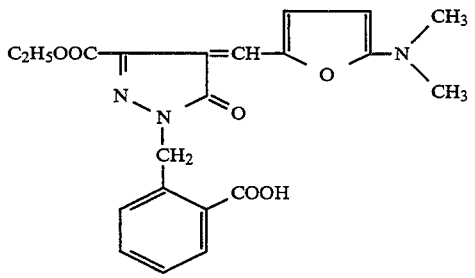

-continued (71)

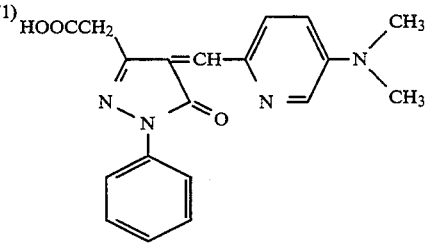

(72)

(73)

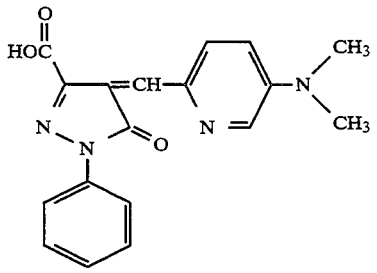

Syntheses of examples of the compound of the present invention are described below. Other example compounds can be synthesized in the same manner.

Synthesis Example 1: Synthesis of Example Compound 2

A mixture of 27.6 g of 1-(4-carboxyphenyl)-3-ethoxycarbonyl-2-pyrazolin-5-one, 14.0 g of 5-dimethylaminofurfural, 10.2 g of triethylamine and 500 ml of ethanol was heated and stirred for 3 hours while refluxing. After the reaction mixture was left to cool, 10.0 g of acetic acid was added. The resulting product was collected by filtration and then purified by slurring in ethanol while refluxing and subsequent collection by filtration. This procedure was repeated until 19.0 g of compound 2 was obtained. This compound was structurally identified by NMR, IR and MASS spectrometry.

The dye used in the present invention is characterized in that when used in a silver halide photographic light-sensitive material, it has no or minimum adverse effect thereon.

With a photographically inert surface, a dye in solid dispersion shows minimum interaction with various photographic additives. Also, it is not likely to adsorb developing accelerators, developing inhibitors and other substances which can affect developing speed, thus tending not to affect sensitivity or fogging. In addition, in producing a photographic light-sensitive material, the photographic coating solution containing the dye of the present invention dispersed therein is stable over time and not susceptible to ionic strength, thus showing no flocculation.

The average particle size of the solid particle dispersion of a dye is preferably from 0.01 μm to 10 μm, more preferably from 0.02 μm to 0.6 μm, and still more preferably from 0.05 μm to 0.6 μm.

Particle size is desirably as uniform as possible, the coefficient of variance for particle size distribution being preferably not higher than 50%, more preferably not higher than 30%, and still more preferably not higher than 20%.

The dye can be dispersed using a conventional mechanical disperser, such as a ball mill, a sand mill, a colloid mill, an ultrasonic disperser, a jet mill or a high speed impeller disperser. When the dye of the present invention is dispersed in an aqueous medium, it is preferable to disperse it at a pH of 7 or lower, more preferably 6.5 or lower. When it is dispersed using a high speed impeller, the dissolver revolution rate is preferably over 1000 rpm, more preferably from 3000 rpm to 15000 rpm.

As for dissolver shape, the diameter/width ratio is preferably 2 to 50, more preferably 3 to 20.

The dye may be converted into solid particle by dissolving it under alkaline conditions and then acidifying the solution to cause precipitation.

The dye may be dispersed into a solid particle form with an anionic polymer. Anionic polymers include polymers having styrenesulfonic acid, naphthalenesulfonic acid, acrylic acid, maleic acid, dextran sulfate or isoprenesulfonic acid as the monomer unit thereof.

The amount of anionic polymer to be present at dispersion of the dye of the present invention is preferably 1 to 100% by weight, more preferably 2 to 30% by weight, relative to the amount of the dye.

The dye is used in the silver halide photographic light-sensitive material so that an optical density of 0.05 to 3.0 will be obtained according to the purpose of its addition.

Any method can be used to add a solid particle dispersion of the dye of the present invention to a light-sensitive material; for example, the method described in U.S. Pat. No. 4,857,446 can be used.

In the present invention, a photographic structural layer is a light-sensitive or non-light-sensitive layer, examples thereof being a light-sensitive silver halide emulsion layer, an interlayer, a protective layer, a filter layer, an anti-halation layer, an anti-irradiation layer or a backing layer. A "non-light-sensitive" layer mentioned herein is a layer having substantially no sensitivity. The dye relating to the present invention is preferably contained in such a non-light-sensitive layer. The coating amount of hydrophilic colloid in the dye-containing non-light sensitive layer is preferably from 0.1 $g/m^2$ to 1.2 $g/m^2$.

Ordinary silver halide emulsions can be used in the light-sensitive material.

The silver halide emulsion relating to the present invention may incorporate a silver halide emulsion optically sensitized with a spectral sensitizing dye in the desired wavelength band. Sensitizing dyes for such optical sensitization include cyanine dyes, merocyanine dyes, complex cyanine dyes, complex merocyanine dyes, holopolar cyanine dyes, hemicyanine dyes, styryl dyes and hemioxanol dyes. Especially useful dyes are cyanine dyes, merocyanine dyes and complex merocyanine dyes. These dyes can have any nucleus which is generally used for cyanine dyes as a basic heterocyclic nucleus. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, nuclei resulting from fusion of these nuclei with an alicyclic hydrocarbon ring, and nuclei resulting from fusion of these nuclei with an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted on a carbon atom.

The merocyanine dye or complex merocyanine dye may have a 5- or 6-membered heterocyclic nucleus such as a pyrazolin-5-one nucleus, a thiohydantoin nucleus, a 2-thioxazolidine-2,4-dione nucleus, a thiazolidine-2,4,-dione nucleus, a rhodanine nucleus or a thiobarbituric acid nucleus as a nucleus having a ketomethylene structure. These sensitizing dyes may be used singly or in combination.

An anti-fogging agent, a stabilizer, etc., can also be incorporated. It is advantageous to use gelatin as an emulsion binder.

Emulsion layers and other hydrophilic colloidal layers may be hardened, and may contain a plasticizer, a dispersion (latex) of a water-insoluble or sparingly water-soluble synthetic polymer, etc.

The light-sensitive material may contain a dye such as an oxonol dye, an arylidene dye, a merocyanine dye and a azo dye.

The light-sensitive material may incorporate a formalin scavenger, a brightening agent, a matting agent, a lubricant, an image stabilizer, a surfactant, an anti-color-fogging agent, a developing accelerator, a developing inhibitor and a bleaching accelerator. For color photographic use, the light-sensitive material may contain a coupler.

Examples of light-sensitive material supports include polyethylene terephthalate films, paper laminated with polyethylene etc., baryta paper and triacetyl cellulose.

When a dye-containing layer is formed between the support and a silver halide emulsion layer, it is preferable that divalent metal ions such as $Ca^{2+}$, $Mg^{2+}$ or $Ba^{2+}$ be present at not higher than 4000 ppm relative to the hydrophilic colloid content in the dye-containing hydrophilic colloid layer. In this case, a gelatin having an isoelectric point of not lower than 6.5 may be used in the hydrophilic colloid layer.

The highly isoelectric gelatin which can be used may be treated with lime or acid. Acid-treated gelatin is preferred because of less swelling and better reticulation.

Other examples of highly isoelectric gelatin are esterified gelatins such as methylated gelatin and amidated gelatins such as aminoethylamide gelatin.

More preferably, the isoelectric point of the gelatin is not lower than 6.8.

The photographic light-sensitive material of the present invention may contains a compound of formula III:

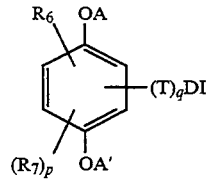

III wherein $R_6$ represents $R_8(R_{10})N—CS—N(R_9)—$, $R_8—CS—N(R_9)—$, $R_8—O—CS-N(R_9)—$, $R_8—S—CS—N(R_9)—$, $R_8—S—CO—N(R_9)—$, $R_8—CO—CO—N(R_9)—$, $R_8—O—CO—CO—N(R_9)—$, $R_8N(R_{10})—CO—CO—N(R_9)—R_8—N(R_{11})—N(R_{10})—CO—N(R_9)—$ in which $R_8$ represents an alkyl group, an aryl group or a heterocyclic group, $R_9$, $R_{10}$ and $R_{11}$ independently represent a hydrogen atom, an alkyl group or an aryl group; $R_7$represents a substituent other than a hydrogen atom; T represents a group which releases DI upon splitting off from the oxidation product of a hydroquinone nucleus, DI representing a developing inhibitor and p and q are integers 0 or 1. A and A' independently represent a hydrogen atom or a group capable of being removed by alkali. $R_6$ and $R_7$ may form a ring.

Examples of the compound of formula III are given below.

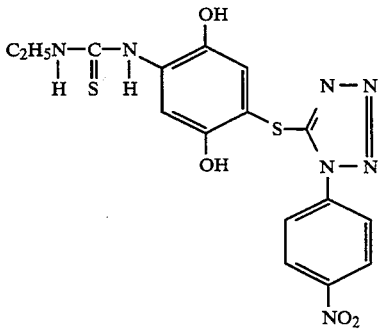

(1')

-continued
(2')
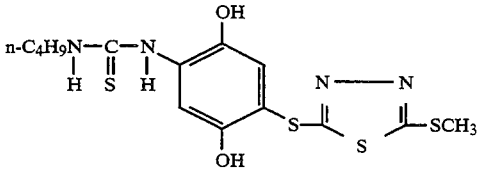
(3')
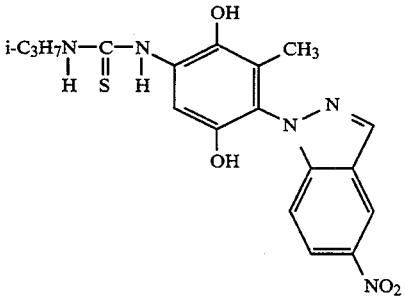
(4')
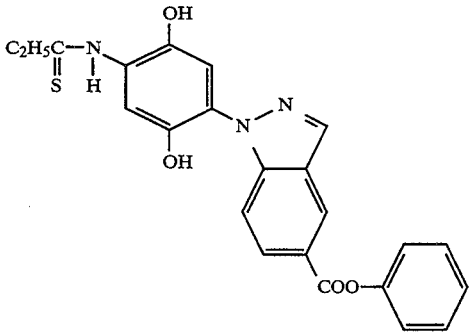
(5')
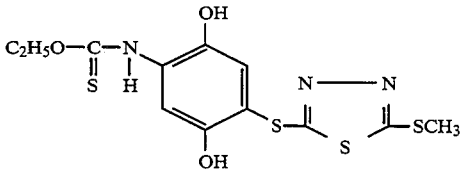
(6')
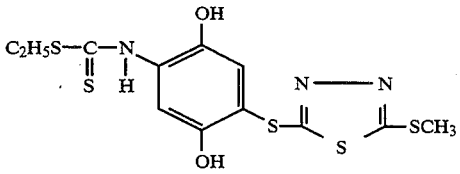
(7')
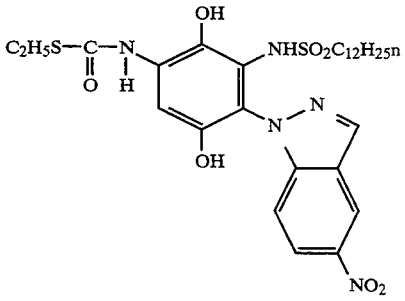
(8')
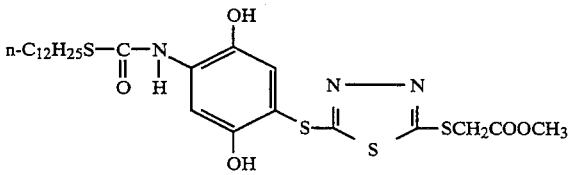

-continued
(9')
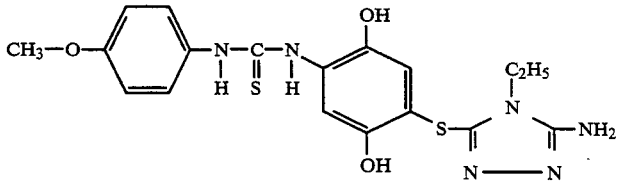
(10')
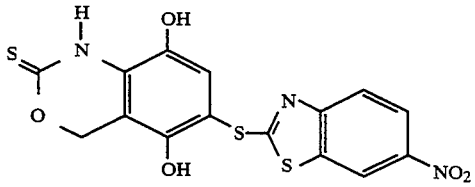
(11')
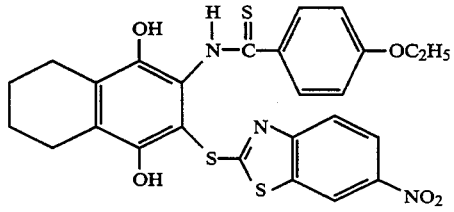
(12')
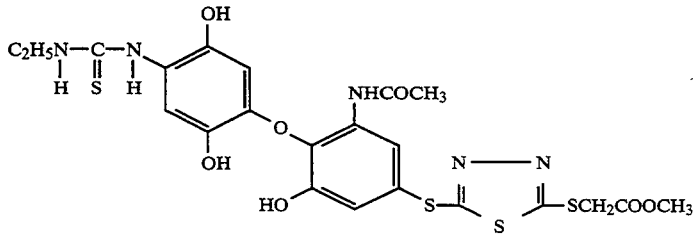
(13')
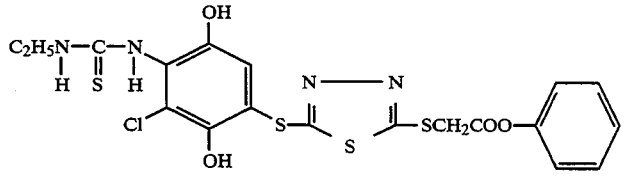
(14')
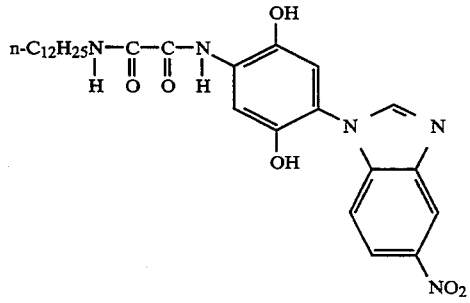
(15')
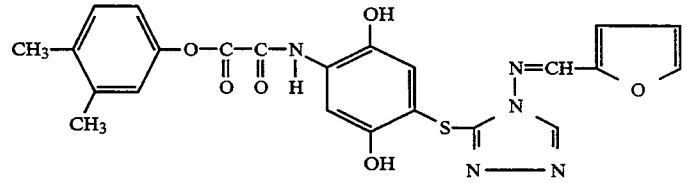

-continued
(16')
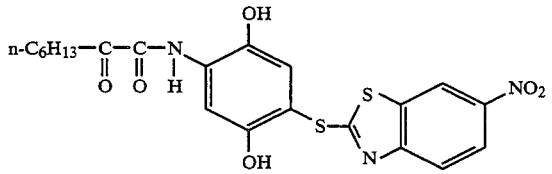
(17')
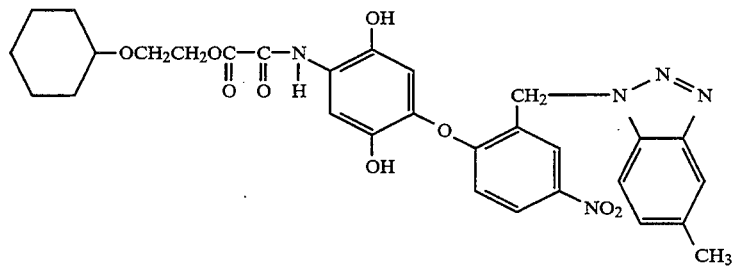
(18')
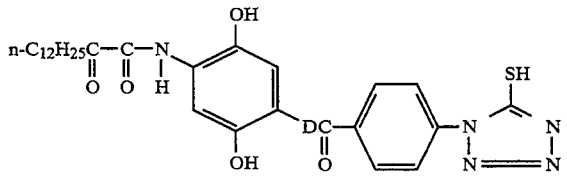
(19')
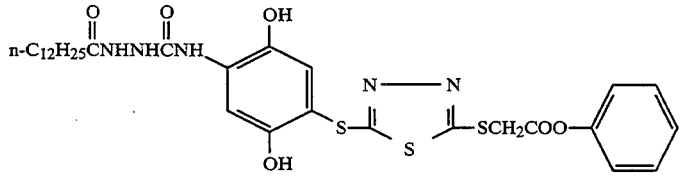
(20')
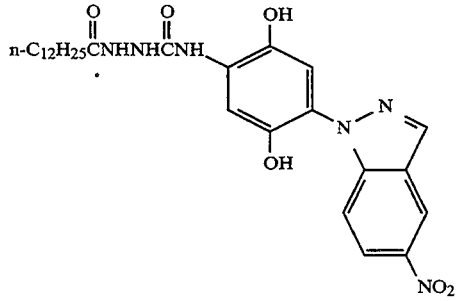
(21')
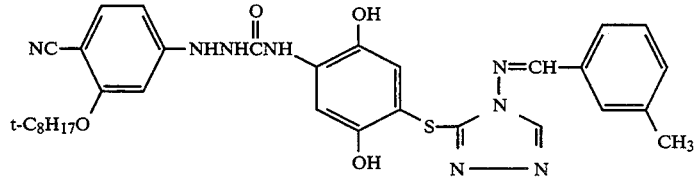

-continued

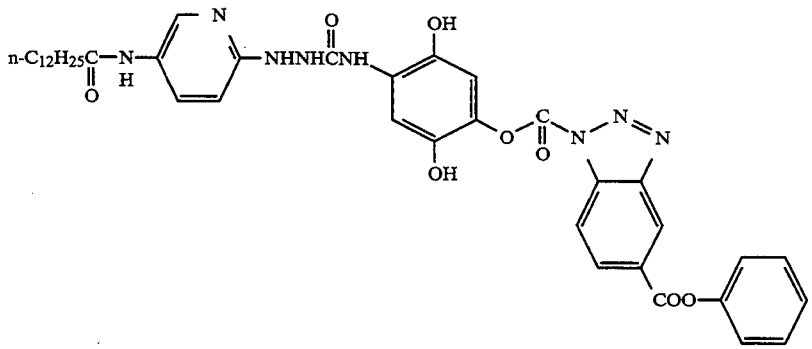

(22')

Syntheses of examples of the compound of the present invention are given below. Other example compounds can be synthesized in the same manner.

Syntheses of examples 2
Example compound (1')

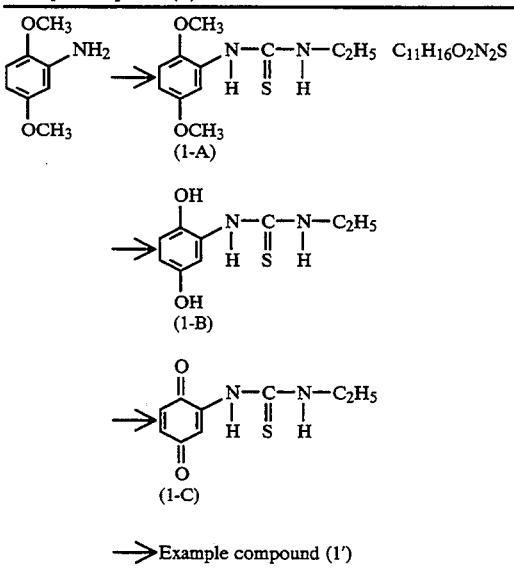

240.2 $C_{11}H_{16}O_2N_2S$ (1-A)

212.2

(1-B)

210.2

(1-C)

432.4

Example compound (1')

1) Synthesis of compound 1-A

To 50 g of 2,5-dimethoxyaniline were added 400 ml of acetonitrile and 26 ml of pyridine, followed by addition of 28.5 g of ethyl isothiocyanate and heating and refluxing for 5 hours. After completion of the reaction, an aqueous hydrochloric acid solution was added to the reaction mixture, which was then extracted with ethyl acetate, washed with water, concentrated and dried, to yield 47 g of the title compound.

2) Synthesis of compound 1-B

To 30 g of the thus-obtained compound 1-A was added 500 ml of 47% hydrobromic acid, followed by heating and refluxing for 4 hours. After completion of the reaction, water was added to the reaction mixture, which was then extracted with ethyl acetate, washed with water, concentrated and dried, to yield 13 g of the title compound.

3) Synthesis of compound 1-C

To 10 g of the thus-obtained compound 1-B were added 400 ml of ethanol and 11 g of 2,3-dichloro-5,6-dicyano-1,4-benzoquinone, followed by stirring at room temperature for 2 hours. After completion of the reaction, the precipitated crystal was collected by filtration, washed with water and dried, to yield 8 g of the title compound.

4) Synthesis of Example Compound 1'

To 4 g of the thus-obtained compound 1-C were added 400 ml of ethyl acetate, 5 g of 5-mercapto-1-(4-nitrophenyl)tetrazole and 0.1 g of p-toluenesulfonic acid monohydrate, followed by stirring at 50° C. for 2 hours. After completion of the reaction, water was added to the reaction mixture, which was then extracted with methylene chloride, washed with water, concentrated and dried, to yield 3.5 g of the title compound.

The compound of formula III is used at $1.0\times10^{-8}$ to $1.0\times10^{-2}$ mol/m$^2$, preferably $1.0\times10^{-7}$ to $1.0\times10^{-4}$ mol/m$^2$.

The compound of formula III can be used in solution in an appropriate water-miscible organic solvent such as an alcohol, a ketone, dimethylsulfoxide, dimethylformamide or methyl cellosolve.

The compound of formula III can also be added as an emulsified dispersion in a known oil. It can also be used in the form of a dispersion prepared by dispersing powder thereof in water by a method known as solid dispersion, using a ball mill, a colloid mill, an impeller disperser or ultrasound.

To meet the requirement for processing time reduction, developing time is preferably not longer than 45 seconds, more preferably not longer than 30 seconds. The photographic light-sensitive material may be dried by infrared irradiation after processing. The infrared drier used for this purpose is equipped outside or inside the automatic processing machine. For short drying time, the dye-containing layer is required to be thin. When the hydrophilic colloid layer contains a dye, its coating amount is not more than 1.0 g/m$^2$, preferably not more than 0.7 g/m$^2$. The swelling rate of the dye-containing layer is not higher than 250%, preferably between 80% and 180%, and more preferably between 100% and 150%.

In the present invention, an image can be obtained by an ordinary method of exposure. Specifically, various known light sources can be used for this purpose, including natural light (sunlight), tungsten lamps, fluorescent lamps, mercury lamps, xenon lamps, arc lamps, carbon arc lamps, xenon flash lamps and cathode ray tube flying spots.

The developer contains a developing agent. Developing agents which can be used for the present invention include dihydroxybenzenes such as hydroquinone, 3-pyrazolidones such as 1-phenyl-3-pyrazolidone, aminophenols such as N-methyl-p-aminophenol, 1-phenyl-3-pyrazolidones, ascorbic acid, and heterocyclic compounds such as those described in U.S. Pat. No. 4,067,872, which result from condensation of a 1,2,3,4-tetrahydroquinoline ring and an indolene ring. These developing agents may be used singly or in combination.

The developer also contains a preservative, an alkali agent, a pH regulator, an antifogging agent, etc., and may also contain a dissolution aid, a toning agent, a developing accelerator, a surfactant, a defoaming agent, a hard water softening agent, a hardener, a tackifier, etc., as necessary.

Application to silver halide photographic light-sensitive material for radiography Silver halide compositions which can be used for light-sensitive silver halide grains include AgBr, AgCl, AgClBr, AgClBrI, AgBrI and AgClBrI, with preference given to AgBr-rich AgBrI.

Cubic, tabular and other forms of silver halide grains can be used, with preference given to tabular grains.

Tabular grains allow epitaxial growth or shelling of silver halides of different compositions in a particular surface portion. Also, to control light-sensitive nuclei, a transition line may be provided on or in the tabular grains. Also, the tabular grains are preferably ones wherein tabular grains having an aspect ratio of not lower than 3 and not higher than 10 account for not lower than 50% of the total weight of all grains in the emulsion layer incorporating the tabular grains. In particular, better results are obtained as the ratio of tabular grains increases from 75% to 90%.

The aspect ratio mentioned herein is defined as the ratio of the diameter of a circle having the same area as the projected area of the subject tabular grain and the distance between two parallel planes.

The tabular grains for the present invention have a thickness of not greater than 0.5 μm, preferably not greater than 0.3 μm. Also, a monodispersed emulsion is preferred wherein the tabular grain distribution width is not higher than 30%, particularly not higher than 20%, in terms of the coefficient of variance (standard deviation S/diameter D×100 with respect to a circle approximated from the projected area of the subject tabular grain), an often used parameter. Tabular grains and non-tabular grains of normal crystal habit may be used in combination.

Application to silver halide photographic light-sensitive material for graphic arts Silver halide compositions which can be used for silver halide grains include AgBr, AgCl, AgClBr, AgClBrI, AgBrI and AgClBrI. In so-called day-light sensitive materials, which are subjected to imagewise exposure by a UV-rich light source, in particular, at least 70 mol % silver chloride is preferably contained, and more preferably the day-light sensitive material contains at least 90 mol % silver chloride and substantially no silver iodide.

Cubic, tabular and other forms of silver halide grains can be used in the silver halide photographic light-sensitive material for graphic arts of the present invention.

To control grain growth during tabular grain formation, ammonia, a thioether compound, a thione compound, etc. can be used as a silver halide solvent.

Also, salts of metals such as zinc, lead, thallium, iridium and rhodium may be present during physical or chemical ripening.

The silver halide emulsion may be sensitized with a sulfur compound or a noble metal salt such as a gold salt. It may also be subjected to reduction sensitization, and may be sensitized by a combination of these methods.

The silver halide emulsion may be coated on a support of polyethylene terephthalate or triacetate cellulose to yield a photographic material.

Gelatin can be crosslinked with an aldehyde such as glyoxal or mucochloric acid, cyanuric acid, aziridine, vinylsulfone compound or the like.

Compounds which can be incorporated in the photographic material of the present invention, such as a masking dye, a sensitizing dye, an antifogging agent, a matting agent, an antistatic agent and a developing speed regulator, can be selected as appropriate according to the desired use and performance.

A polyhydroxybenzene compound or a pyrazolidone compound is preferably used. Examples of such compounds include hydroquinone, catechol, resorcinol, pyrogallol, 4-t-butyl-1,2-dihydroxybenzene, 1-aminosulfo-2,4-dihydroxybenzene, 1-phenyl-3-pyrazolidone, 1-phenyl-4-dimethyl-3-pyrazolidone and 1-phenyl-4-hydroxymethyl-4-methyl-3-pyrazolidone.

The silver halide photographic light-sensitive material may have a compound having an —NHNHCO— group in its molecular structure incorporated in a light-sensitive silver halide emulsion layer or a hydrophilic colloid layer adjacent thereto, for the purpose of tone adjustment. Examples of compounds having an —NHNHCO— group include Compound Nos. I-1 through I-17 and II-1 through II-11 described on pages 3 through 5 of Japanese Patent O.P.I. Publication No. 36540/1991 and Example Compounds (1) through (75) described on pages 44 through 48 of Japanese Patent Application No. 841/1990. When the photographic material of the present invention contains a compound having an —NHNHCO— group, it can be to process it with a developer having a pH value of lower than 10.8 for not shorter than 30 seconds and obtain a contrast value of not lower than 10.

The present invention may also have a tetrazolium compound incorporated in at least one light-sensitive silver halide emulsion layer or a hydrophilic colloidal layer adjacent thereto, for the purpose of tone adjustment. A tetrazolium compound is exemplified by formula II in Japanese Patent O.P.I. Publication No. 15039/1991, specifically Compound Nos. II-1 through II-18 described on pages 11 and 12 of that publication.

The photographic light-sensitive material preferably contains a compound which releases a photographically useful group, preferably a developing inhibitor, upon oxidation. This compound is preferably a compound having an —NHNHCO— group or the compound of formula III.

The developer replenishing rate in processing the photographic light-sensitive material is preferably not higher than 200 ml/m$^2$ per m$^2$ of the photographic light-sensitive material. In this case, the silver halide grains used in the photographic light-sensitive material of the present invention are preferably AgCl or AgBrCl grains containing at least 60 mol % silver chloride, the dye-containing hydrophilic colloid layer may contains an anionic polymer which preferably has a carboxyl group or a sulfo group.

The photographic light-sensitive material is preferably processed with washing water containing 0.05 ppm to 4000 ppm, more preferably 0.1 ppm to 500 ppm calcium ions.

EXAMPLE 1

In all examples given below, the amount of addition in silver halide photographic light-sensitive material is expressed in gram per $m^2$, unless otherwise stated. The figures for silver halide and colloidal silver have been converted to the amounts of silver.

Layers of the following compositions were formed on a triacetyl cellulose film support in this order from the support side to prepare a multi-layered color photographic light-sensitive material (sample No. 1).

| Sample No. 1-1 (comparative) | |
|---|---|
| Layer 1: Anti-halation layer HC-1 | |
| Black colloidal silver | 0.20 |
| UV absorbent UV-1 | 0.20 |
| Colored coupler CC-1 | 0.05 |
| Colored coupler CM-2 | 0.05 |
| High boiling solvent Oil-1 | 0.20 |
| Gelatin | 1.5 |
| Layer 2: First interlayer IL-1 | |
| UV absorbent UV-1 | 0.01 |
| High boiling solvent Oil-1 | 0.01 |
| Gelatin | 1.5 |
| Layer 3: Low speed red-sensitive emulsion layer RL | |
| Silver iodobromide emulsion Em-1 | 0.8 |
| Silver iodobromide emulsion Em-2 | 0.8 |
| Sensitizing dye S-1 | $2.5 \times 10^{-4}$ (mol/mol silver) |
| Sensitizing dye S-2 | $2.5 \times 10^{-4}$ (mol/mol silver) |
| Sensitizing dye S-3 | $0.5 \times 10^{-4}$ (mol/mol silver) |
| Cyan coupler C-1 | 0.5 |
| Cyan coupler C-2 | 0.05 |
| Cyan coupler C-4 | 0.5 |
| Colored cyan coupler CC-1 | 0.05 |
| DIR compound D-1 | 0.002 |
| High boiling solvent Oil-1 | 0.5 |
| Gelatin | 1.5 |
| Layer 4: High speed red-sensitive emulsion layer RH | |
| Silver iodobromide emulsion Em-3 | 2.0 |
| Sensitizing dye S-1 | $2.0 \times 10^{-4}$ (mol/mol silver) |
| Sensitizing dye S-2 | $2.0 \times 10^{-4}$ (mol/mol silver) |
| Sensitizing dye S-3 | $0.1 \times 10^{-4}$ (mol/mol silver) |
| Cyan coupler C-2 | 0.015 |
| Cyan coupler C-3 | 0.10 |
| Cyan coupler C-4 | 0.25 |
| Colored cyan coupler CC-1 | 0.015 |
| DIR compound D-2 | 0.05 |
| High boiling solvent Oil-1 | 0.2 |
| Gelatin | 1.5 |
| Layer 5: Second interlayer IL-2 | |
| Gelatin | 0.5 |
| Layer 6: | |
| Low speed green-sensitive emulsion layer GL | |
| Silver iodobromide emulsion Em-1 | 1.0 |
| Sensitizing dye S-4 | $5.0 \times 10^{-4}$ (mol/mol silver) |
| Sensitizing dye S-5 | $1.0 \times 10^{-4}$ (mol/mol silver) |
| Magenta coupler M-1 | 0.5 |
| Colored magenta coupler CM-1 | 0.01 |
| DIR compound D-3 | 0.02 |
| DIR compound D-4 | 0.02 |

-continued

| Sample No. 1-1 (comparative) | |
|---|---|
| High boiling solvent Oil-2 | 0.3 |
| Gelatin | 1.0 |
| Layer 7: Third interlayer IL-3 | |
| Gelatin | 0.8 |
| Layer 8: | |
| High speed green-sensitive emulsion layer GH | |
| Silver iodobromide emulsion Em-3 | 1.3 |
| Sensitizing dye S-6 | $1.5 \times 10^{-4}$ (mol/mol silver) |
| Sensitizing dye S-7 | $2.5 \times 10^{-4}$ (mol/mol silver) |
| Sensitizing dye S-8 | $0.5 \times 10^{-4}$ (mol/mol silver) |
| Magenta coupler M-2 | 0.05 |
| Magenta coupler M-3 | 0.15 |
| Colored magenta coupler CM-2 | 0.05 |
| DIR compound D-3 | 0.01 |
| High boiling solvent Oil-3 | 0.5 |
| Gelatin | 1.0 |
| Layer 9: Yellow filter layer YC | |
| Yellow colloidal silver | 0.1 |
| Antistaining agent SC-1 | 0.1 |
| High boiling solvent Oil-3 | 0.1 |
| Gelatin | 0.8 |
| Layer 10: | |
| Low speed blue-sensitive emulsion layer BL | |
| Silver iodobromide emulsion Em-1 | 0.25 |
| Silver iodobromide emulsion Em-2 | 0.25 |
| Sensitizing dye S-10 | $7.0 \times 10^{-4}$ (mol/mol silver) |
| Yellow coupler Y-1 | 0.5 |
| Yellow coupler Y-2 | 0.1 |
| DIR compound D-2 | 0.01 |
| High boiling solvent Oil-3 | 0.3 |
| Gelatin | 1.0 |
| Layer 11: | |
| High speed blue-sensitive emulsion layer BH | |
| Silver iodobromide emulsion Em-4 | 0.50 |
| Silver iodobromide emulsion Em-1 | 0.20 |
| Sensitizing dye S-9 | $1.0 \times 10^{-4}$ (mol/mol silver) |
| Sensitizing dye S-10 | $3.0 \times 10^{-4}$ (mol/mol silver) |
| Yellow coupler Y-1 | 0.30 |
| Yellow coupler Y-2 | 0.05 |
| High boiling solvent Oil-3 | 0.15 |
| Gelatin | 1.1 |
| Layer 12: First protective layer Pro-1 | |
| Fine silver iodobromide grain emulsion having an average grain size of 0.08 μm and an AgI content of 2 mol % | 0.4 |
| UV absorbent UV-1 | 0.10 |
| UV absorbent UV-2 | 0.05 |
| High boiling solvent Oil-1 | 0.1 |
| High boiling solvent Oil-4 | 0.1 |
| Formalin scavenger HS-1 | 0.5 |
| Formalin scavenger HS-2 | 0.2 |
| Gelatin | 1.0 |
| Layer 13: Second protective layer Pro-2 | |
| Surfactant Su-1 | 0.005 |
| Alkali-soluble matting agent having an average grain size of 2 μm | 0.05 |
| Polymethyl methacrylate having an average grain size of 3 μm | 0.05 |
| Cyan dye AIC-1 | 0.005 |
| Magenta dye AIM-1 | 0.01 |
| Lubricant WAX-1 | 0.04 |
| Gelatin | 0.6 |

In addition to these compositions, a coating aid Su-2, a dispersing agent Su-3, a hardener H-1 (40 mg/g gelatin), a stabilizer Stab-1 and an antifogging agent AF-1 were added to appropriate layers.

Em-1: Monodispersed core/shell emulsion comprising grains having a low surface silver iodide content, an average grain size of 0.46 μm and an average silver iodide content of 7.0 mol %.

Em-2: Monodispersed emulsion comprising uniformly composed grains having an average grain size of 0.30 μm and an average silver iodide content of 2.0 mol %.

Em-3: Monodispersed core/shell emulsion comprising grains having a low surface silver iodide content, an average grain size of 0.81 μm and an average silver iodide content of 7.0 mol %.

Em-4: Monodispersed core/shell emulsion comprising grains having a low surface silver iodide content, an average grain size of 0.95 μm and an average silver iodide content of 8.0 mol %.

S-1

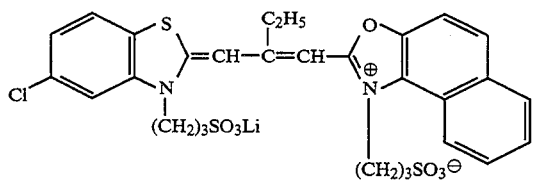

S-2

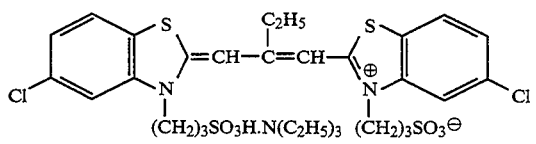

S-3

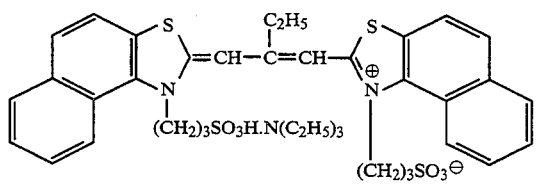

S-4

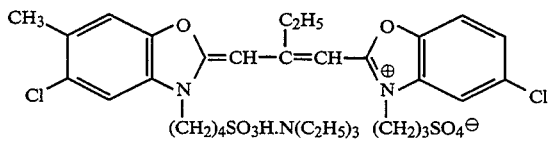

S-5

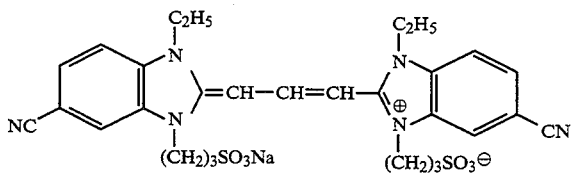

S-6

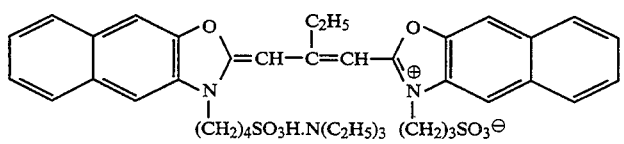

S-7

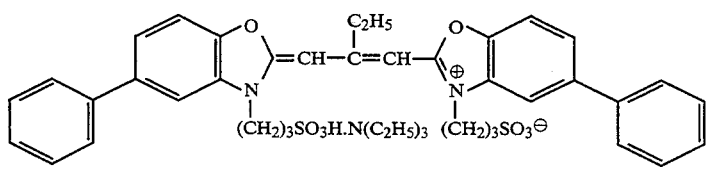

S-8

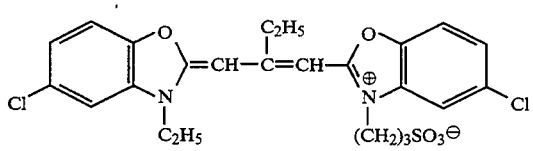

-continued
S-9
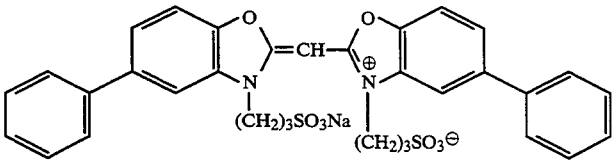
S-10
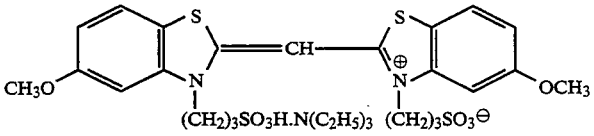
C-1
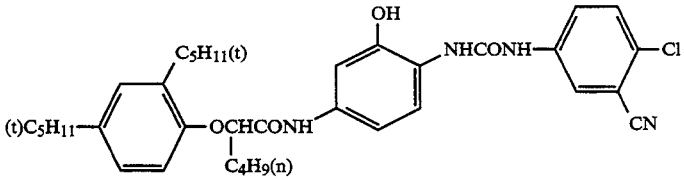
C-2
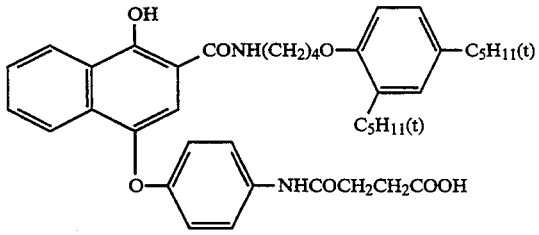
C-3
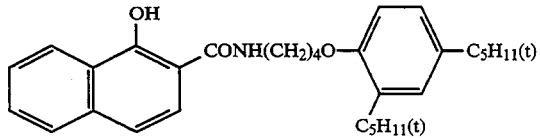
C-4
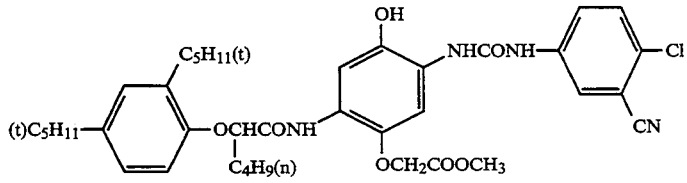
M-1
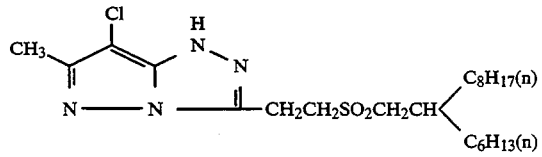
M-2
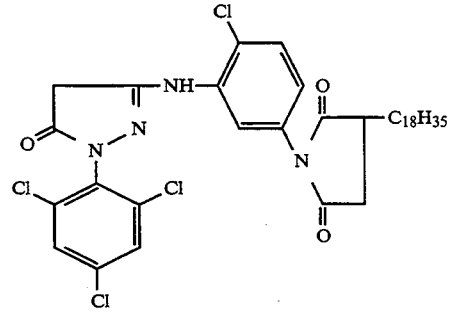

-continued
M-3
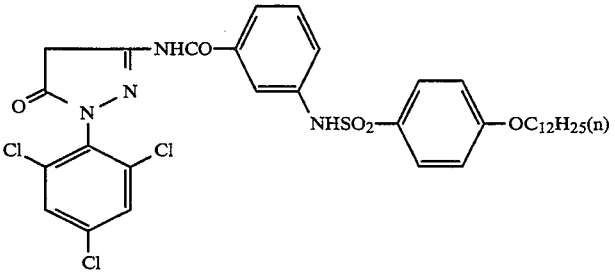
Y-1
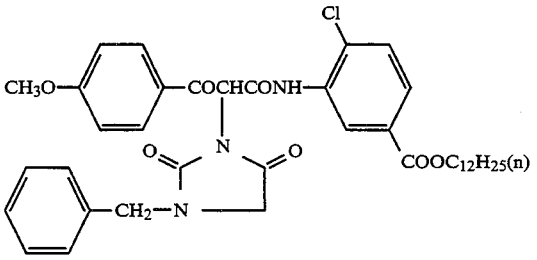
Y-2
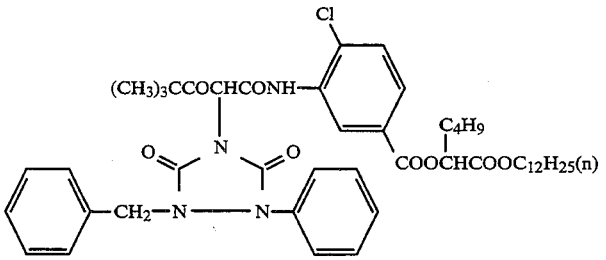
CC-1
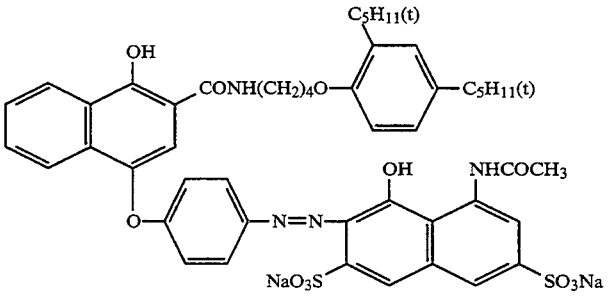
CM-1
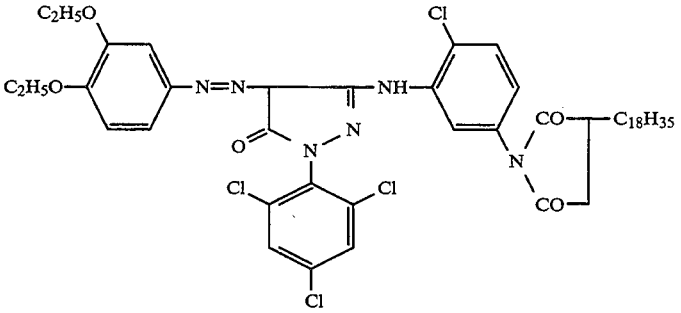

-continued
CM-2
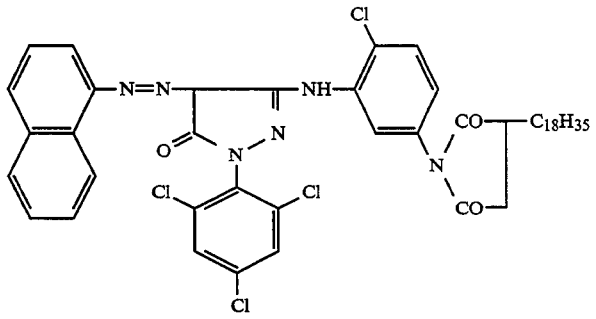
D-1
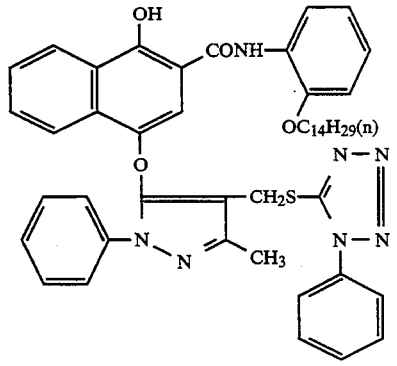
D-2
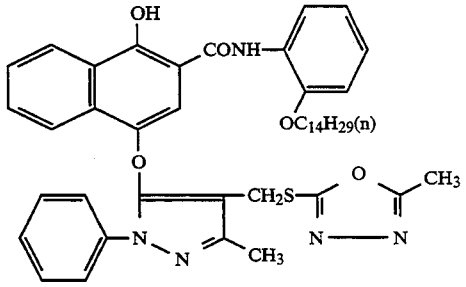
D-3
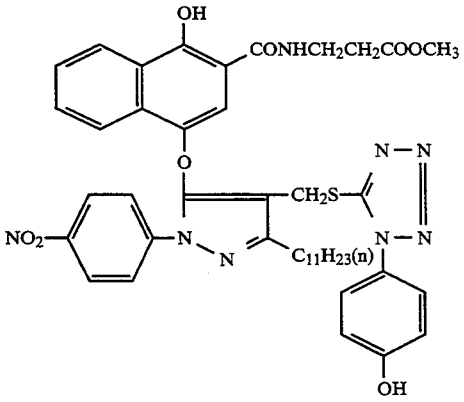

-continued
D-4
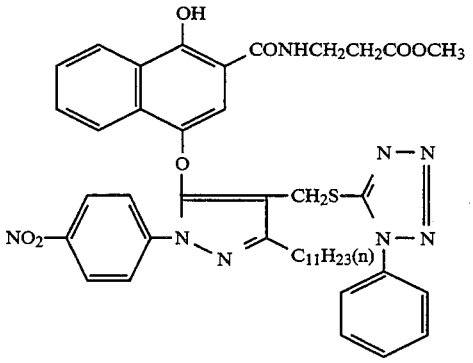
UV-1
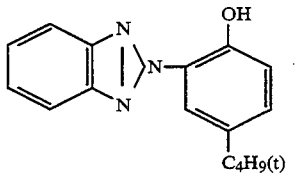
UV-2
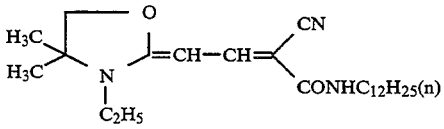
HS-1
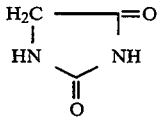
HS-2
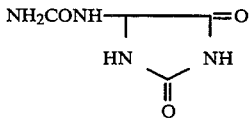
H-1
$CH_2{=}CHSO_2CH_2OCH_2SO_2CH{=}CH_2$
SU-1
$NaO_3S{-}CH(CH_2COOCH_2(CF_2CF_2)_3H)COOCH_2(CF_2CF_2)_3H$
SU-2
$NaO_3S{-}CH(CH_2COOC_8H_{17})COOC_8H_{17}$
SU-3
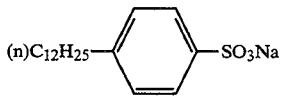
SC-1
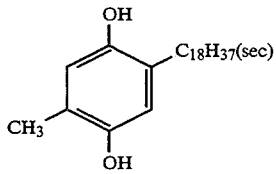

-continued
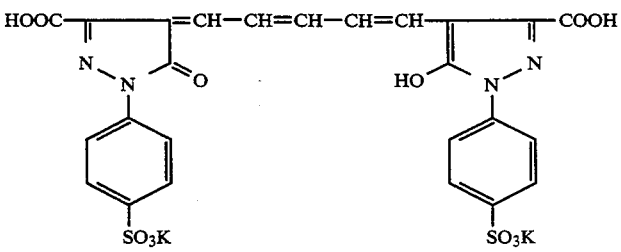
AIC-1
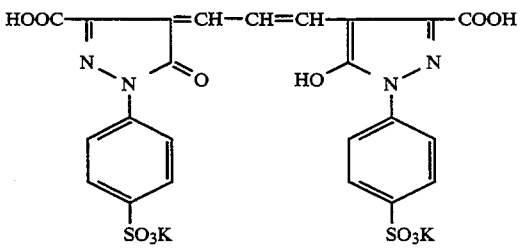
AIM-1
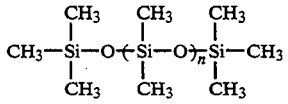
WAX-1
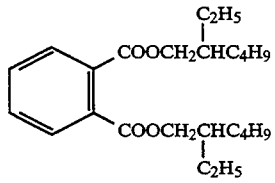
Oil-1
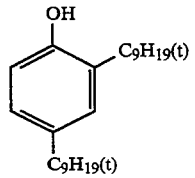
Oil-2
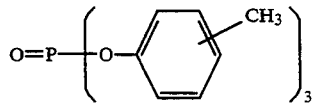
Oil-3
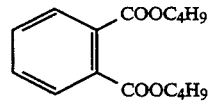
Oil-4
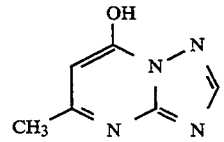
S tab-1
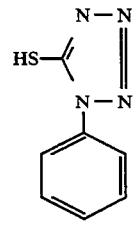
AF-1

Preparation of sample No. 1-2

A multi-layered color photographic light-sensitive material (sample No. 1-2) was prepared in the same manner as for sample No. 1-1 except that a dye shown in Table 1, in place of yellow colloidal silver in layer 9, along with high boiling solvent Oil-3, an antistaining agent SC-1 and a surfactant Alkanol XC (alkylnaphthalene sulfonate, produced by Du-Pont), was dissolved in ethyl acetate, and that the resulting solution, along with gelatin, was dispersed and coated.

Preparation of sample Nos. 1-3 through 1-10

Dyes to be used in sample Nos. 1-3 through 1-10, listed in Table 1, were dispersed into solid particle in a ball mill as follows:

To the ball mill container were added water and a surfactant Alkanol XC. After each dye was added, zirconium oxide beads were added, and the container was sealed tight, followed by dispersion in the ball mill for 4 days.

Then an aqueous gelatin solution was added, followed by stirring for 10 minutes, after which the beads were removed, to yield a coating solution. Multi-layered color photographic light-sensitive materials (sample Nos. 1-3 through 1-10) were prepared in the same manner as for sample No. 1-1 except that this coating solution was used to form layer 9. The amount of dye added was such that the final coating amount would be 0.3 g/m$^2$ in each of sample Nos. 1-1 through 1-10.

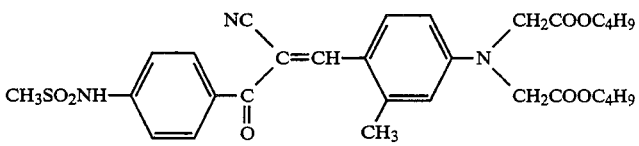

Comparative dye 1

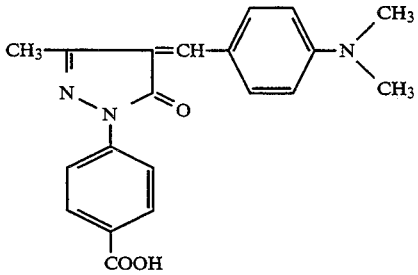

Comparative dye 2

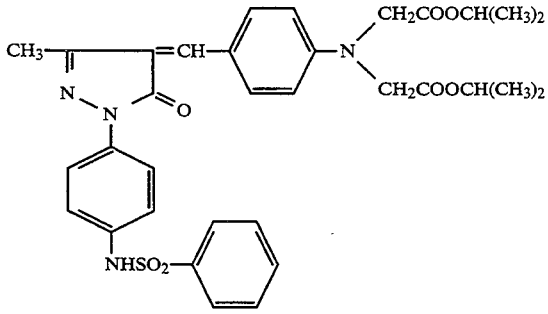

Comparative dye 3

The thus-prepared sample Nos. 1-1 through 1-10 were each subjected to white light exposure through an optical wedge and then developed by the following process:

| Process A (38° C.) | Processing time |
|---|---|
| Color development | 3 minutes 15 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |
| Drying | |

The processing solutions used in the respective processes had the following compositions:

| Color developer | |
|---|---|
| 4-amino-3-methyl-N-ethyl-N-(β-hydroxylethyl)aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |
| Water was added to make a total quantity of | 1 l. |

Water was added to make a total quantity of 1 l.

| Bleacher | |
|---|---|
| Ammonium iron ethylenediaminetetraacetate | 100.0 g |
| Diammonium ethylenediaminetetraacetate | 10.0 g |
| Ammonium bromide | 150.0 g |
| Glacial acetic acid | 10.0 ml |

Water was added to make a total quantity of 1 l, and aqueous ammonia was added to obtain a pH of 6.0.

| Fixer | |
|---|---|
| Ammonium thiosulfate | 175.0 g |
| Anhydrous sodium sulfite | 8.5 g |
| Sodium metasulfite | 2.3 g |

Water was added to make a total quantity of 1 l, and acetic acid was added to obtain a pH of 6.0.

| Stabilizer | |
|---|---|
| Formalin (37% aqueous solution) | 1.5 ml |
| Konidax (produced by Konica Corporation) | 7.5 ml |

Water was added to make a total quantity of 1 l.

A processing solution was prepared which had the same composition as of the color developer used in the above processing except that 4-amino-3-methyl-N-ethyl-N-(β-hydroxylethyl)aniline sulfate was removed. Using this processing solution, color developing was conducted, followed by bleaching, fixing and stabilizing processes in the same manner as in processing A (this processing is referred to as processing B). The effect of the dye on fogging was evaluated as follows:

Effect on fogging $\Delta D_{B2}$=difference between the minimum yellow density in processing A and the minimum yellow density in processing B, in each sample (sample Nos. 1-1 through 1-10)

Also, after storage at 55° C. and 80% relative humidity for 3 days, each sample was subjected to the above processing A, and the decrease in the blue sensitive emulsion layer sensitivity $\Delta S_B$ was determined.

$\Delta S_B$ = (blue-sensitive emulsion layer sensitivity after 3 days of storage at 55° C. and 80% RH)/(blue-sensitive emulsion layer sensitivity before storage) × 100(%)

Blue-sensitive emulsion layer sensitivity is expressed as the reciprocal of the exposure amount at a density equivalent to (minimum density+0.3). The results are given in Table 1.

TABLE 1

| Sample | 9th layer | $\Delta D_{B2}$ | $\Delta S_B$ |
|---|---|---|---|
| Comparative 1-1 | Yelow colloidal silver | 0.12 | 93% |
| Comparative 1-2 | Comparative dye 1 | 0.08 | 78% |
| Comparative 1-3 | Comparative dye 2 | 0.08 | 84% |
| Comparative 1-4 | Comparative dye 3 | 0.07 | 85% |
| Inventive 1-5 | Inventive Compound (2) | 0.05 | 94% |
| Inventive 1-6 | Inventive Compound (6) | 0.06 | 93% |
| Inventive 1-7 | Inventive Compound (16) | 0.05 | 95% |
| Inventive 1-8 | Inventive Compound (20) | 0.05 | 94% |
| Inventive 1-9 | Inventive Compound (36) | 0.06 | 94% |
| Inventive 1-10 | Inventive Compound (46) | 0.06 | 94% |

From Table 1, it is seen that the samples according to the present invention had improved fogging in the blue-sensitive layer, in comparison with the sample incorporating yellow colloidal silver. Also, comparative dyes 1, 2 and 3 (sample Nos. 1-2 through 1-4) had blue-sensitive layer sensitivity reduction during storage, while the samples incorporating the compound of the present invention had less affected fogging, indicating good storage stability.

EXAMPLE 2

Layers of the following compositions were formed on a subbed triacetyl cellulose film support in this order from the support side to prepare a multi-layered color photographic light-sensitive material (comparative sample No. 2-1). The amount of each component coated is expressed in gram per $m^2$.

| Sample No. 2-1 | |
|---|---|
| Layer 1: Anti-halation layer | |
| UV absorbent UV-1 | 0.3 |
| UV absorbent UV-2 | 0.4 |
| High boiling solvent Oil-1 | 1.0 |
| Black colloidal silver | 0.24 |
| Gelatin | 2.0 |
| Layer 2: First interlayer | |
| 2,5-di-t-octylhydroquinone | 0.1 |
| High boiling solvent Oil-1 | 0.2 |
| Gelatin | 1.0 |
| Layer 3: Low speed red-sensitive emulsion layer | |
| Silver iodobromide emulsion spectrally sensitized with red sensitizing dyes S-1 and S-11 (AgI content 4.0 mol %, average grain size 0.25 μm) | 0.5 |
| Coupler C-5 | 0.1 mol |
| High boiling solvent Oil-3 | 0.6 |
| Gelatin | 1.3 |
| Layer 4: High speed red-sensitive emulsion layer | |
| Silver iodobromide emulsion spectrally sensitized with red sensitizing dyes S-1 and S-11 (AgI content 2.0 mol %, average grain size 0.6 μm) | 0.8 |
| Coupler C-5 | 0.2 mol |
| High boiling solvent Oil-3 | 1.2 |
| Gelatin | 1.8 |
| Layer 5: Second interlayer | |
| 2,5-di-t-octylhydroquinone | 0.1 |
| High boiling solvent Oil-4 | 0.2 |
| Gelatin | 0.9 |
| Layer 6: Low speed green-sensitive emulsion layer | |
| Silver iodobromide emulsion spectrally sensitized with green sensitizing dyes S-12 and S-13 (AgI content 4.0 mol %, average grain size 0.25 μm) | 0.6 |
| Coupler M-4 | 0.04 mol |
| Coupler M-5 | 0.01 mol |
| High boiling solvent Oil-1 | 0.5 |
| Gelatin | 1.4 |
| Layer 7: High speed green-sensitive emulsion layer | |
| Silver iodobromide emulsion spectrally sensitized with green sensitizing dyes S-12 and S-13 (AgI content 2.0 mol %, average grain size 0.6 μm) | 0.9 |
| Coupler M-4 | 0.10 mol |
| Coupler M-5 | 0.02 mol |
| High boiling solvent Oil-1 | 1.0 |
| Gelatin | 1.5 |
| Layer 8: Third interlayer | |
| The same as layer 5. | |
| Layer 9: Yellow filter layer | |
| Yellow colloidal silver | 0.1 |
| Gelatin | 0.9 |
| 2,5-di-t-octylhydroquinone | 0.1 |
| High boiling solvent Oil-4 | 0.2 |
| Layer 10: Low speed blue-sensitive emulsion layer | |
| Silver iodobromide emulsion spectrally sensitized with blue Sensitizing dye S-14 (AgI content 4.0 mol %, average grain size 0.35 μm) | 0.6 |
| Coupler Y-2 | 0.3 mol |
| High boiling solvent Oil-1 | 0.6 |
| Gelatin | 1.3 |
| Layer 11: High speed blue-sensitive emulsion layer | |
| Silver iodobromide emulsion spectrally sensitized with blue sensitizing dye S-14 (AgI content 2.0 mol %, average grain size 0.9 μm) | 0.9 |

-continued

| Sample No. 2-1 | |
|---|---|
| Coupler Y-2 | 0.5 mol |
| High boiling solvent Oil-1 | 1.4 |
| Gelatin | 2.1 |
| Layer 12: First protective layer | |
| UV absorbent UV-1 | 0.3 |
| UV absorbent UV-2 | 0.4 |
| High boiling solvent Oil-1 | 0.6 |
| Gelatin | 1.2 |
| 2,5-di-t-octylhydroquinone | 0.1 |
| Layer 13: Second protective layer | |
| Non-light-sensitive silver halide emulsion comprising silver iodobromide micrograins having an average grain size of 0.08 μm and a silver iodide content of 1 mol % | 0.8 (as of silver) |
| Polymethyl methacrylate grains having an average grain size of 1.5 μm | |
| Surfactant Su-1 | |
| Gelatin | 0.7 |

In addition to these compositions, a gelatin hardener H-1, a surfactant and other additives were added to appropriate layers.

Sensitizing dye S-11

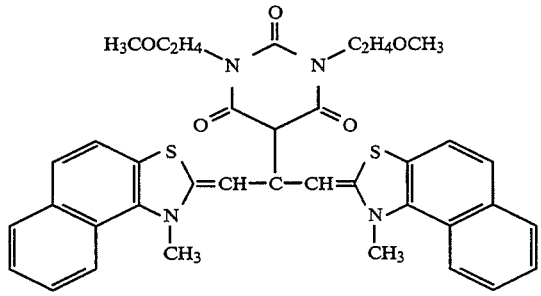

Sensitizing dye S-12

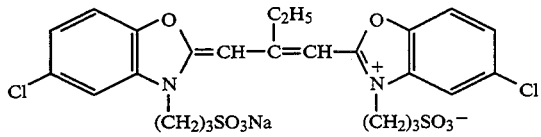

Sensitizing dye S-13

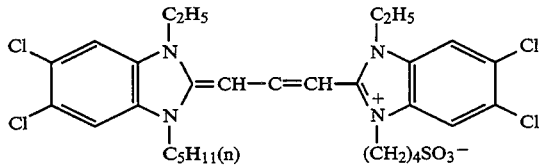

Sensitizing dye S-14

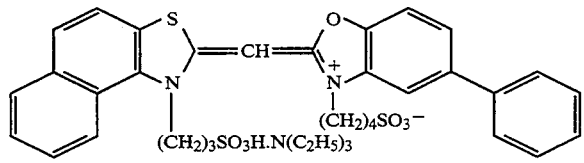

Coupler C-5

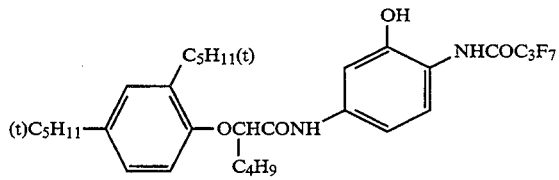

Coupler M-4

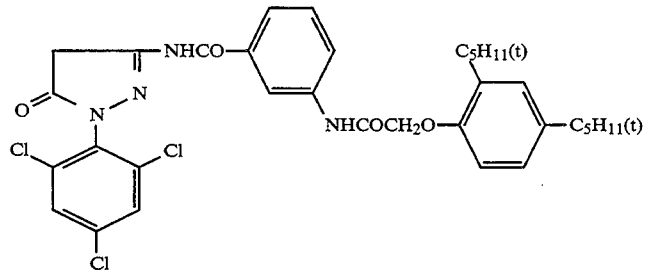

-continued

Coupler M-5

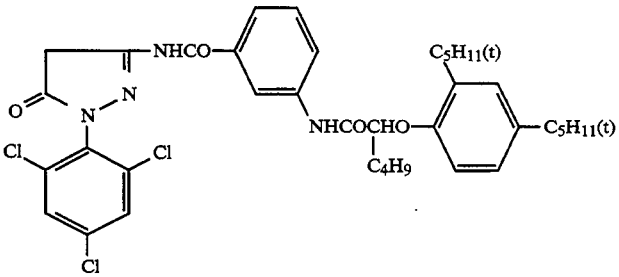

Preparation of sample No. 2-2

A multi-layered color photographic light-sensitive material (sample No. 2-2) was prepared in the same manner as for sample No. 2-1 except that a dye shown in Table 2, in place of yellow colloidal silver in layer 9, along with high boiling solvent Oil-4 and 2,5-dioctylhydroquinone, was dissolved in ethyl acetate, and that the resulting solution, along with gelatin, was dispersed and coated.

Preparation of sample Nos. 2-3 through 2-10

Dyes to be used in sample Nos. 2-3 through 2-10, listed in Table 2, were dispersed into solid particle in a ball mill as follows:

To the ball mill container were added water and a surfactant Alkanol XC (alkylnaphthalene sulfonate, produced by Du-Pont). After each dye was added, zirconium oxide beads were added, and the container was sealed tight, followed by dispersion in the ball mill for 4 days.

Then an aqueous gelatin solution was added, followed by stirring for 10 minutes, after which the beads were removed, to yield a coating solution. Multi-layered color photographic light-sensitive materials (sample Nos. 2-3 through 2-10) were prepared in the same manner as for sample No. 2-1 except that this coating solution was used to form layer 9.

The amount of dye added was such that the final coating amount would be 0.3 g/m$^2$ in each of sample Nos. 2-1 through 2-10.

The thus-prepared sample Nos. 2-1 through 2-10 were each subjected to white light exposure through an optical wedge and then developed by the following process:

| Process | Processing time | Processing temperature |
|---|---|---|
| First development | 6 minutes | 38° C. |
| Washing | 2 minutes | 38° C. |
| Reversal development | 2 minutes | 38° C. |
| Color development | 6 minutes | 38° C. |
| Adjustment | 2 minutes | 38° C. |
| Bleaching | 6 minutes | 38° C. |
| Fixation | 4 minutes | 38° C. |
| Washing | 4 minutes | 38° C. |
| Stabilization | 1 minute | Normal temp. |
| Drying | | |

The processing solutions used in the respective processes had the following compositions:

| | |
|---|---|
| First developing solution | |
| Sodium tetrapolyphosphate | 2 g |
| Sodium sulfite | 20 g |
| Hydroquinone monosulfonate | 30 g |

-continued

| | |
|---|---|
| Sodium carbonate monohydrate | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water was added to make a total quantity of | 1000 ml |
| Reversal developer | |
| Hexasodium nitrilotrimethylenephosphonate | 3 g |
| Stannous chloride dihydrate | 1 g |
| p-aminophenol | 0.1 g |
| Sodium hydroxide | 8 g |
| Glacial acetic acid | 15 ml |
| Water was added to make a total quantity of | 1000 ml. |
| Color developer | |
| Sodium tetrapolyphosphate | 3 g |
| Sodium sulfite | 7 g |
| Trisodium phosphate dihydrate | 36 g |
| Potassium bromide | 1 g |
| Potassium iodide (0.1% solution) | 90 ml |
| Sodium hydroxide | 8 g |
| Citrazinic acid | 1.5 g |
| N-ethyl-N-β-methanesulfonamidoethyl-3-methyl-4-aminoaniline sulfate | 11 g |
| 2,2-ethylenedithiodiethanol | 1 g |
| Water was added to make a total quantity of | 1000 ml. |
| Adjuster | |
| Sodium sulfite | 12 g |
| Sodium ethylenediaminetetraacetate dihydrate | 8 g |
| Thioglycerol | 0.4 ml |
| Glacial acetic acid | 3 ml |
| Water was added to make a total quantity of | 1000 ml. |
| Bleacher | |
| Sodium ethylenediaminetetraacetate dihydrate | 2 g |
| Ammonium iron (III) ethylenediaminetetraacetate dihydrate | 120 g |
| Ammonium bromide | 100 g |
| Water was added to make a total quantity of | 1000 ml. |
| Fixer | |
| Ammonium thiosulfate | 80 g |
| Sodium sulfite | 5 g |
| Sodium bisulfite | 5 g |
| Water was added to make a total quantity of | 1000 ml. |
| Stabilizer | |
| Formalin (37% by weight aqueous solution) | 5 ml |
| Konidax (produced by Konica Corporation) | 5 ml |
| Water was added to make a total quantity of | 1000 ml. |

For each developed sample, maximum ($D_{max}$) and minimum ($D_{min}$) densities were determined after blue light exposure.

Also, after storage at 55° C. and 80% relative humidity for 4 days, each sample was subjected to the above exposure and processing, and the decrease in the blue-sensitive emulsion layer sensitivity $\Delta S_B$ was determined and compared with the value obtained before storage.

$\Delta S_B$ = (blue-sensitive emulsion layer sensitivity after 4 days of storage at 55° C. and 80% RH)/(blue-sensitive emulsion layer sensitivity before storage) × 100(%)

Blue-sensitive emulsion layer sensitivity is expressed as the reciprocal of the exposure amount corresponding to a density of 2.0.

The results are given in Table 2.

TABLE 2

| Sample | 9th layer | Dmin | Dmax | $\Delta S_B$ |
|---|---|---|---|---|
| Comparative 2-1 | Yelow colloidal silver | 0.15 | 3.56 | 93% |
| Comparative 2-2 | Comparative dye 1 | 0.14 | 3.70 | 81% |
| Comparative 2-3 | Comparative dye 2 | 0.13 | 3.69 | 86% |
| Comparative 2-4 | Comparative dye 3 | 0.13 | 3.69 | 88% |
| Inventive 2-5 | Inventive Compound (3) | 0.11 | 3.76 | 94% |
| Inventive 2-6 | Inventive Compound (14) | 0.11 | 3.75 | 94% |
| Inventive 2-7 | Inventive Compound (20) | 0.12 | 3.74 | 93% |
| Inventive 2-8 | Inventive Compound (39) | 0.11 | 3.74 | 94% |
| Inventive 2-9 | Inventive Compound (40) | 0.12 | 3.73 | 93% |
| Inventive 2-10 | Inventive Compound (45) | 0.12 | 3.73 | 93% |

From Table 2, it is seen that the samples according to the present invention had higher maximum density, in comparison with the sample incorporating yellow colloidal silver. Also, comparative samples, which incorporated respective comparative dyes, had higher minimum densities and more blue-sensitive layer sensitivity reduction during storage, while the samples incorporating the compound of the present invention had lower minimum densities, sufficient maximum density and good storage stability.

EXAMPLE 3

| Preparation of emulsion layer coating solutions | |
|---|---|
| Solution A | |
| Water | 9.7 l |
| Sodium chloride | 20 g |
| Gelatin | 105 g |
| Solution B | |
| Water | 3.8 l |
| Sodium chloride | 365 g |
| Gelatin | 94 g |

-continued

| Preparation of emulsion layer coating solutions | |
|---|---|
| Potassium bromide | 450 g |
| 0.01% aqueous solution of potassium hexachloroiridate | 28 ml |
| 0.01% aqueous solution of potassium hexabromorhodate | 1.0 ml |
| Solution C | |
| Water | 3.8 l |
| Silver nitrate | 1.700 g |

While keeping the above solution A at 40° C. and maintaining a pH of 3 and a pAg of 7.7, the above solutions B and C were simultaneously added functionally over a 60-minute period, followed by stirring for 10 minutes. After this mixture was adjusted to pH 6.0 with an aqueous sodium carbonate solution, 2 l of a 20% aqueous magnesium sulfate solution and 2.55 l of a 5% aqueous polynaphthalenesulfonic acid solution were added. Then the emulsion was flocculated at 40° C. and decanted, after which it was washed with water to remove excess aqueous salts.

The emulsion was then dispersed in 3.7 l of water, and 0.9 l of a 20% aqueous magnesium sulfate solution was again added, followed by the same procedure as above to remove excess aqueous salts. To this emulsion were added 3.7 l of water and 141 g of gelatin, followed by dispersion at 55° C. for 30 minutes.

Grains having a monodispersibility of 9, a silver bromide content of 38 mol %, a silver chloride content of 62 mol % and an average grains size of 0.25 μm were thus obtained. After 140 ml of a 1% aqueous citric acid solution and 57 ml of a 5% aqueous potassium bromide solution were added to these grains, 70 ml of a 0.1% sodium thiosulfate solution was added, followed by ripening at 58° C. for 70 minutes.

After ripening was terminated by addition of 10 g of 4-hydroxy-6-methyl-1,3,3a,7-tetrazaindene, as a stabilizer, and 1600 ml of a 20% aqueous gelatin solution, the following sensitizing dyes (a), (b) and (c), in amounts of 3.5 g, 1 g and 1 g, respectively, were added, followed by addition of 7 g of compound (d) as a contrast improving agent and subsequent addition of 10 g of sodium p-dodecylbenzenesulfonate as a spreading agent, 30 g of saponin, 120 g of a butyl acrylate-acrylic acid-styrene copolymer as polymer latex, 3 g of potassium bromide as a pAg regulator and 20 g of styrene-maleic anhydride copolymer as a thickener, and formalin and glyoxal as hardeners, to yield an emulsion layer coating solution.

(a)

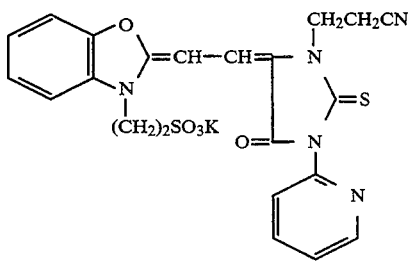

(b)

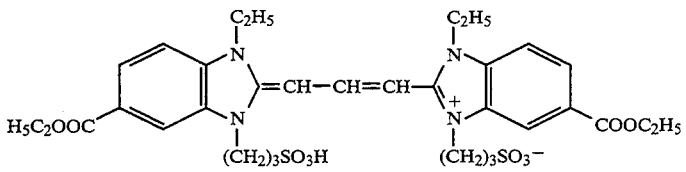

-continued (c)

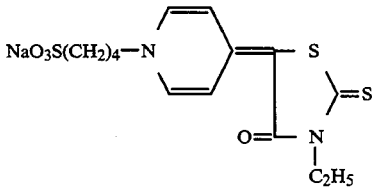

(d)

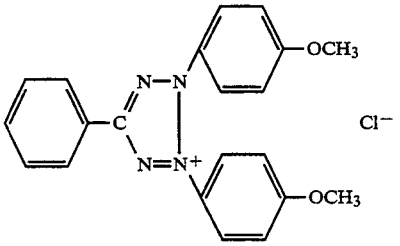

Preparation of protective layer coating solution 500 g of gelatin was dissolved in 7.5 l of water. To this solution were added 15 g of the following compound (e) as a spreading agent, 10 g of silica having an average grain size of 3.5 μm as a matting agent, and formalin as a hardener, to yield a protective layer coating solution.

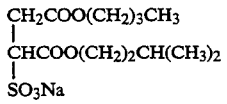

Compound (e)

Preparation of lower backing layer coating solution 650 g of gelatin was dissolved in 10 l of water. In this solution was dispersed each of the compounds listed in Table 3 into solid particle in the same manner as in Example 1. The resulting dispersion was added to a coating amount of 0.2 g/m$^2$, followed by addition of 30 g of saponin as a spreading agent, 30 g of butyl acrylate-vinylidene chloride copolymer as a polymer latex, 150 g of colloidal silica as an agent for improving physical property of the layer, 3 g of styrene-maleic anhydride copolymer as a thickening agent and 2.5 g of glyoxal as a hardener, to yield a lower backing layer coating solution.

Preparation of upper backing layer coating solution 400 g of gelatin was dissolved in 600 ml of water. To this solution were added 20 g of polymethyl methacrylate having an average grain size of 4 μm as a matting agent, 3 g of sodium bis-(2-ethylhexyl)sulfosuccinate as a spreading agent and glyoxal as a hardener, to yield an upper backing layer coating solution.

Preparation of sample

A lower backing layer and an upper backing layer were simultaneously coated on a subbed polyethylene terephthalate film base of 100 μm thickness, followed by simultaneous coating of an emulsion layer and a protective layer on the face opposite to the backing layer. The amount of silver coated was 4.2 g/m$^2$, and the amount of gelatin coated was 1.95 g/m$^2$ for the emulsion layer, 1.2 g/m$^2$ for the protective layer, 2.7 g/m$^2$ for the lower backing layer and 1.0 g/m$^2$ for the upper backing layer.

Each obtained sample was processed with the following developer and fixer, using an automatic processing machine GR-27 (produced by Konica Corporation), after which it was evaluated as to dot quality and storage stability. The results are given in Table 3.

Dot quality

The sample was subjected to dot exposure to a 90% dot area and then processed. Dot quality was assessed in ten grades, grade 10 indicating the best dot quality, grade 1 indicating the worst level, grades 5 or higher indicating practically acceptable levels.

Storage stability

The sample was kept at 23° C. and 50% RH for moisture conditioning, after which it was tightly packed with its emulsion face and backing face in contact. This sample was stored at a temperature of 50° C. and a relative humidity of 20% for 5 days, after which its sensitivity, in percent ratio, was determined in comparison with the sensitivity of the sample before storage.

Here, sensitivity is expressed as the reciprocal of the exposure amount required to obtain a density of 2.5.

| Processing conditions | | |
|---|---|---|
| Process | Processing temperature | Processing time |
| Development | 28° C. | 30 seconds |
| Fixation | 28° C. | 20 seconds |
| Washing | Normal temp. | About 20 seconds |
| Drying | 45° C. | 20 seconds |

| Developer | |
|---|---|
| Composition A | |
| Deionized water | 150 ml |
| Disodium ethylenediaminetetraacetate | 2 g |
| Diethylene glycol | 50 g |
| Potassium sulfite (55% w/v aqueous solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium bromide | 4.5 g |
| Aqueous potassium hydroxide amount required to obtain pH 10.4 | |
| Composition B | |
| Deionized water | 3 ml |
| Diethylene glycol | 50 g |
| Disodium ethylenediaminetetraacetate | 25 mg |
| Acetic acid (90% aqueous solution) | 0.3 ml |

-continued

| | |
|---|---|
| 5-nitroindazole | 110 mg |
| 1-phenyl-3-pyrazolidone | 500 mg |

The above compositions A and B were dissolved in 500 ml of water in this order, and water was added to make a total quantity of 1 l for the developer.

| Fixer | |
|---|---|
| Composition A | |
| Ammonium thiosulfate (72.5% w/v aqueous solution) | 240 ml |
| Sodium sulfite | 17 g |
| Sodium acetate trihydrate | 6.5 g |
| Sodium citrate dihydrate | 2 g |
| Boric acid | 6 g |
| Acetic acid (90% w/v aqueous solution) | 13.6 ml |
| Composition B | |
| Deionized water | 17 ml |
| Sulfuric acid (50% w/v aqueous solution) | 4.7 g |
| Aluminum sulfite (aqueous solution containing 8.1% w/w $Al_2O_3$) | 26.5 g |

The above compositions A and B were dissolved in 500 ml of water in this order, and water was added to make a total quantity of 1 l for the fixer.

This fixer had a pH of about 4.3.

TABLE 3

| Sample | Compound used | Dot quality | Storage stability 50° C. × 5 days |
|---|---|---|---|
| Comparative 3-1 | Comparative dye 2 | 5 | 139 |
| Comparative 3-2 | Comparative dye 3 | 6 | 72 |
| Inventive 3-3 | Inventive Compound (4) | 9 | 105 |
| Inventive 3-4 | Inventive Compound (5) | 8 | 102 |
| Inventive 3-5 | Inventive Compound (12) | 8 | 97 |
| Inventive 3-6 | Inventive Compound (19) | 8 | 96 |
| Inventive 3-7 | Inventive Compound (28) | 8 | 108 |
| Inventive 3-8 | Inventive Compound (38) | 9 | 106 |

From Table 3, it is seen that sample Nos. 3-3 through 3-8, all prepared according to the present invention, offer good dot quality and excellent storage stability.

EXAMPLE 4

A silver halide photographic light-sensitive material was prepared as follows:

First, an emulsion was prepared as follows:

(A) Preparation of monodispersed emulsion

While maintaining reactor conditions of 60° C. pAg 8 and pH 2, a monodispersed emulsion comprising cubic silver iodobromide grains having an average grain size of 0.3 μm and a silver iodide content of 2 mol % was prepared by the double jet method. Electron microscopy revealed that the ratio of twin crystals was not higher than 1% by number. Using this emulsion as a seed crystal, grains were grown as follows:

While keeping an aqueous gelatin solution at 40° C. in the reactor, the above seed crystal was added, followed by addition of aqueous ammonia and acetic acid to obtain a pH of 9.5.

After pAg was adjusted to 7.3 with an ammoniacal silver ion solution, a solutions containing ammoniacal silver ions and a solution containing potassium iodide and potassium bromide were added by the double jet method, while maintaining constant pH and pAg, to yield a silver iodobromide layer containing 30 mol % silver iodide. After solution adjustment to pH 9 and pAg 9.0 with acetic acid and silver bromide, an ammoniacal silver ion solution and potassium bromide were added simultaneously, and grains were grown until their size reached 90% of the fully grown grains, while pH was gradually lowered from 9.0 to 8.20.

After solution adjustment to pAg 11 with a potassium bromide solution, an ammoniacal silver ion solution and potassium bromide were added, and grains were grown while gradually lowering pH to 8, to yield a silver iodobromide emulsion having an average grain size of 0.7 [μm and a silver iodide content of 2 mol %. In preparing the emulsion, the following sensitizing dyes A and B were added at 300 mg and 15 mg per mol silver, respectively, to yield a sensitized emulsion.

Sensitizing dye A

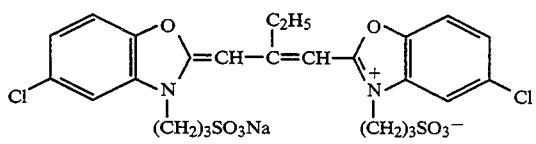

Sensitizing dye B

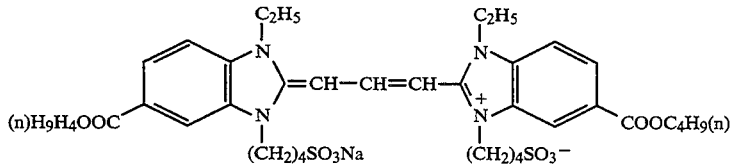

Desalinization was then conducted to remove excess salts as follows:

While keeping the silver halide emulsion at 40° C., the following compound (a) (equivalent to Example Compound II-1 shown in Japanese Patent O.P.I. Publication No. 140322/1983) was added to precipitate silver halide grains. After supernatant removal, 40° C. deionized water was added, followed by addition of magnesium sulfate to precipitate silver halide grains and subsequent supernatant removal. This procedure was repeated once again, followed by addition of gelatin, to yield an emulsion of pH 6.0 and pAg 8.5.

Compound (a)

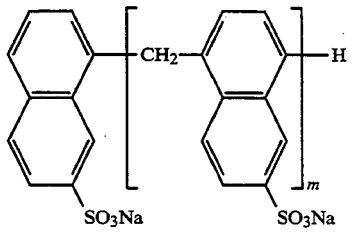

(m indicates the degree of polymerization.)

While keeping the thus-obtained emulsion at 55° C., chloroauric acid and hypo were added to conduct chemical sensitization, followed by addition of 4-hydroxy-6-methyl-1,3,3a,7-tetrazaindene, to yield a light-sensitive emulsion. This emulsion is referred to as emulsion A.

To the thus-obtained light-sensitive emulsion A were added additives including the following, in the respective amounts per mol of silver halide shown below, to yield an emulsion coating solution.

| | |
|---|---|
| t-butyl-catechol | 400 mg |
| polyvinylpyrrolidone (molecular weight 10,000) | 1.0 g |
| Styrene-maleic anhydride copolymer | 2.5 g |
| Trimethylolpropane | 10.0 g |
| Diethylene glycol | 5.0 g |
| Nitrophenyl-triphenylphosphonium chloride | 50 mg |
| Ammonium 1,3-dihydroxybenzene-4-sulfonate | 4.0 g |
| Sodium 2-mercaptobenzimidazole-5-sulfonate | 5.0 mg |
| 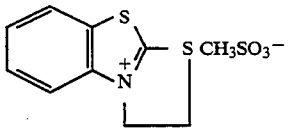 | 70 mg |
| 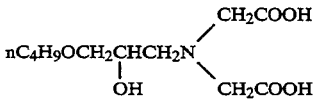 | 1 g |
| 1,1-dimethylol-1-bromo-1-nitromethane | 10 mg |
| 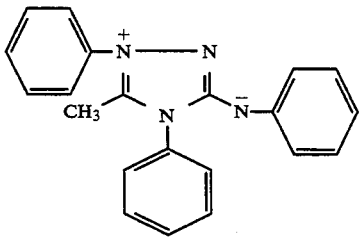 | 150 mg |

Another coating solution was prepared as a protective layer coating solution by adding the following compounds, in the respective amounts per gram of gelatin shown below, to yield a protective layer coating solution.

| | |
|---|---|
| 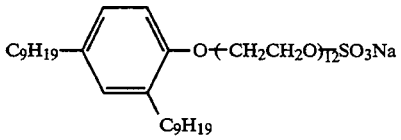 | 12 mg |

-continued

| | |
|---|---|
| 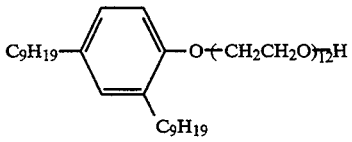 | 2 mg |
| 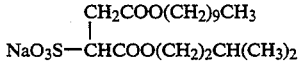 | 7 mg |
| 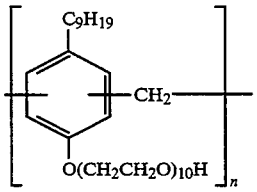 (a mixture wherein n varies from 2 to 5) | 15 mg |
| 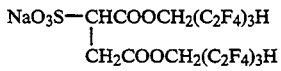 | 5 mg |
| $F_{19}C_9—O(CH_2CH_2O)_{10}CH_2CH_2OH$ | 3 mg |
| Matting agent polymethyl methacrylate having an average grain size of 7 μm | 7 mg |
| Colloidal silica (average grain size of 0.013 μm) | 70 mg |
| 2-hydroxy-4,6-dichlorotriazine sodium | 30 mg |

Using the above coating solutions, sample No. 4-1 was prepared as follows:

Sample No. 4-1

A support was subbed on both faces with an aqueous dispersion containing 10 wt. % of a copolymer of 50 wt. % glycidyl methacrylate, 10 wt. % methyl methacrylate and 40 wt. % butyl methacrylate. Both faces of this support were then simultaneously coated with an emulsion layer at a one-face silver coating amount of 3.2 g/m$^2$ and with a protective layer at a one-face gelatin coating amount of 0.98 g/m$^2$, at a coating speed of 140 m/min.

Sample No. 4-2

A sample was prepared in the same manner as for sample No. 4-1 except that a crossover cut layer containing each dye shown in Table 4 was inserted between the emulsion layer and the subbing layer. The dye, in solution in methanol containing a small amount of triethylamine, was added to an aqueous gelatin solution, followed by pH adjustment to 6.0, to yield a coating solution.

Sample Nos. 4-3 through 4-10

Coating was conducted so that a crossover cut layer was inserted in the same manner as for sample No. 4-2 except that the dye was added by solid particle dispersion in the same manner as in Example 1. For sample Nos. 4-2 through 4-10, the amount of dye added was such that its coating amount would be 50 mg/m$^2$ for both faces.

The obtained samples were evaluated as follows:

Sensitometry

Using standard light B described in "Illumination Data Book, new edition" (in Japanese), as a light source, each sample was subjected to filterless exposure at 3.2 cm/s for 0.1 second so that the exposure amount was constant for both film faces. This sample was processed with XD-SR developer for 45 seconds, using an SRX-501 automatic processing machine (produced by Konica Corporation), followed by fixation and drying. The sensitivity of each sample was then determined. Sensitivity is expressed as the reciprocal of the exposure amount required to increase the black density by 1.0, in percent ratio relative to the sensitivity of sample No. 4-1 shown in Table 4.

Evaluation of MTF

An MTF chart of lead having a 0.5 to 10 lines/mm rectangular wave pattern was brought into contact with the back face of a fluorescent screen KO-250 (produced by Konica Corporation) on the front side, and X-ray was irradiated so that the density in the film's portion not shaded by the lead chart would be about 1.0 for both faces.

The sample thus irradiated with X-ray was processed in the same manner as above, after which the recorded rectangular wave pattern was measured, using Sakura microdensitometer M-5 (produced by Konica Corporation). The aperture size was 300 μm in the direction parallel to the rectangular wave and 25 μm in the right angle direction, magnifying power being ×20. As a representative, the MTF value obtained at a spacial frequency of 2.0 lines/mm was used.

TABLE 4

| Sample | Crossover cut substance | Sensitivity | MTF |
|---|---|---|---|
| Comparative 4-1 (*) | None | 100 | 0.48 |
| Comparative 4-2 | Inventive Compound (61) | 85 | 0.52 |
| Comparative 4-3 | Comparative dye 4 | 89 | 0.54 |
| Inventive 4-4 | Inventive Compound (54) | 92 | 0.57 |
| Inventive 4-5 | Inventive Compound (57) | 92 | 0.58 |
| Inventive 4-6 | Inventive Compound (59) | 91 | 0.57 |
| Inventive 4-7 | Inventive Compound (61) | 91 | 0.56 |
| Inventive 4-8 | Inventive Compound (62) | 92 | 0.57 |
| Inventive 4-9 | Inventive Compound (63) | 93 | 0.58 |
| Inventive 4-10 | Inventive Compound (65) | 94 | 0.59 |

(*) This Sample does not have a crossover cut layer.
Comparative dye 4

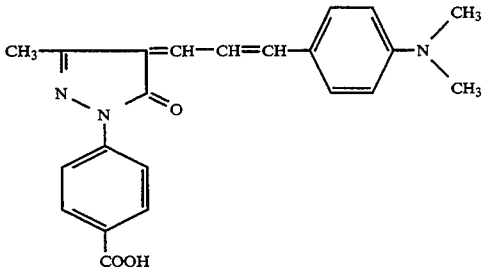

As seen in Table 4, the samples according to the present invention had improved sharpness and less sensitivity reduction, in comparison with the comparative samples.

Next, in place of the above-described monodispersed emulsion A, the following polydispersed emulsion B and tabular emulsion C were prepared.

(B) Preparation of polydispersed emulsion

The following four solutions were mixed by the single jet method.

| | |
|---|---|
| Solution A | |
| Silver nitrate | 100 g |
| Aqueous ammonia (28%) | 78 ml |
| Water was added to make a total quantity of | 240 ml. |
| Solution B | |
| Ossein gelatin | 8 g |
| Potassium bromide | 80 g |
| Potassium iodide | 1.3 g |
| Water was added to make a total quantity of | 550 ml. |
| Solution C | |
| Aqueous ammonia | 6 ml |
| Glacial acetic acid | 10 ml |
| Water | 34 ml |
| Solution D | |
| Glacial acetic acid | 226 ml |
| Water was added to make a total quantity of | 400 ml. |

Solutions B and C were added to a reactor for emulsion preparation, followed by stirring using a propeller type mechanical stirrer at 300 rpm, while maintaining a reaction temperature of 55° C.

Solution A was divided into two portions in a 1:2 ratio by volume. The ⅓ portion (100 ml) was added over a 1-minute period, followed by stirring for 10 minutes, after which the remaining ⅔ (200 ml) was added over a 10-minute period, followed by stirring for 30 minutes. Solution D was then added to obtain a solution pH of 6.0 in the reactor and terminate the reaction.

The thus-obtained silver halide grains had an average grain size of 0.56 μm, a degree of dispersion of 0.32 and a silver iodide content of 1.2 mol %.

(C) Preparation of tabular grains 10.5 g of KBr, 10 ml of a 0.5 wt. % aqueous solution of thioether compound $HO(CH_2)_2S(CH_2)_2S(CH_2)_2OH$ and 30 g of gelatin were dissolved in 1 l of water, and this solution was kept at 70° C.

While stirring this solution, 30 ml of an aqueous silver nitrate solution (0.88 mol/l) and 30 ml of another aqueous solution of potassium iodide and potassium bromide (molar ratio 3.5:96.5) (0.88 mol/l) were added by the double jet method to yield grains having an average grain size of 0.60 μm and a silver iodide content of 3.5 mol %. After completion of the addition, the temperature was lowered to 40° C. To this mixture were added sodium naphthalenesulfonate-formalin condensation product and $MgSO_4$, each at 24.6 g/mol AgX, followed by pH adjustment to 4.0 and desalinization, after which 15 g of gelatin per mol of AgX was added, to yield an emulsion.

The emulsions obtained in (B) and (C) above were chemically sensitized by gold-sulfur sensitization with ammonium thiocyanate, chloroauric acid and hypo.

After completion of the chemical sensitization, 4-hydroxy-6-methyl-1,3,3a,7-tetrazaindene was added, followed by spectral sensitization by addition of 150 mg of potassium iodide per mol of AgX and sensitizing dyes A and B in the same amounts as for emulsion A. The thus-obtained emulsions are referred to as emulsions B and C, respectively.

To each of the light-sensitive emulsions B and C were added the same additives as those added to emulsion A, to yield emulsion coating solutions. After the dye of the present invention was added in a solid particle dispersion, these coating solutions and the above-described protective layer coating solution were coated so that a crossover cut layer would be inserted; samples having improved sharpness and less sensitivity reduction were obtained.

The present invention provides a silver halide photographic light-sensitive material which shows little fogging and which has improved storage stability and excellent photographic performance.

EXAMPLE 5

Synthesis of latex Lx-A

To 60 l of water were added 1.0 kg of gelatin, 0.01 kg of sodium dodecylbenzenesulfonate and 0.05 kg of ammonium persulfate. While stirring this solution at a solution temperature of 60° C., a mixture of (a) 3.0 kg of styrene, (b) 3.0 kg of methyl methacrylate and (c) 3.2 kg of ethyl acrylate, and 0.8 kg of sodium 2-acrylamido-2-methylpropanesulfonate were added in a nitrogen atmosphere over a 1-hour period, followed by stirring for 1.5 hours. Then after the residual monomer was removed by steam distillation for 1 hour, the mixture was cooled to room temperature and then adjusted to pH 6.0 with ammonia. Water was added to the resulting latex liquid to make a total quantity of 75 kg. A monodispersed latex having an average grain size of 0.1 μm was thus obtained.

Preparation of silver halide photographic emulsion A

A silver nitrate solution and an aqueous solution of sodium chloride and potassium bromide containing rhodium hexachloride complex at $8\times10^{-5}$ mol/mol Ag were simultaneously added to a gelatin solution, while controlling the feed rates, followed by desalinization, to yield a monodispersed silver chlorobromide emulsion comprising cubic grains having an average grain size of 0.13 μm and a silver bromide content of 1 mol %.

This emulsion was subjected to sulfur sensitization by an ordinary method, and 6-methyl-4-hydroxy-1,3,3a,7-tetrazaindene was added as a stabilizer, after which the following additives were added to prepare an emulsion coating solution. Subsequently, an emulsion protective layer coating solution, a backing layer coating solution and a backing protective layer coating solution were prepared with the following compositions.

| Preparation of emulsion coating solution | |
|---|---|
| Potassium bromide | 5 mg/m$^2$ |
| Compound (a) | 1 mg/m$^2$ |
| NaOH (0.5 N) | Amount required to obtain pH 5.6 |
| Saponin (20%) | 0.5 ml/m$^2$ |
| Sodium dodecylbenzenesulfonate | 20 mg/m$^2$ |
| 5-methylbenzotriazole | 10 mg/m$^2$ |
| Compound (d) | 2 mg/m$^2$ |
| Compound (e) | 10 mg/m$^2$ |
| Compound (f) | 6 mg/m$^2$ |
| Latex Lx-A | |
| Styrene-maleic acid copolymer (thickener) | 90 mg/m$^2$ |

This coating solution was coated so that the amount of gelatin coated would be 1.2 g/m$^2$.

(a)

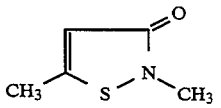

-continued (d)

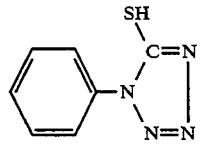

(e)

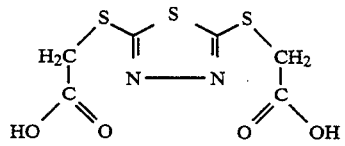

(f)

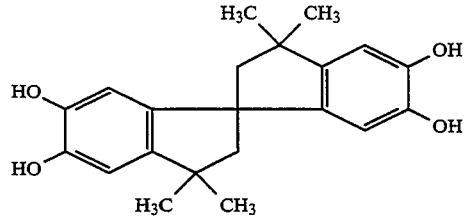

| Preparation of emulsion protective layer coating solution | |
|---|---|
| Gelatin | 1.1 g/m$^2$ |
| Compound (solid particle dispersion of dye shown in Table 5) | 80 mg/m$^2$ (as of dye solid content) |
| Compound (k) | 100 mg/m$^2$ |
| Monodispersed spherical silica (8μ) | 20 mg/m$^2$ |
| Monodispersed spherical silica (3μ) | 10 mg/m$^2$ |
| Compound (i) | 100 mg/m$^2$ |
| Compound (g) | 1 mg/m$^2$ |
| Citric acid | Amount required to obtain pH 5.8 |
| Latex Lx-A | |
| Styrene-maleic acid copolymer (thickener) | 50 mg/m$^2$ |
| Formaldehyde (hardener) | 10 mg/m$^2$ |

Solid particle dispersions of the dyes shown in Table 5 were prepared by dispersing respective compounds into solid particle in a ball mill as follows:

To the ball mill container were added water and surfactant alkanol XC (alkylnaphthalene sulfonate, produced by Du-Pont). After each dye was added, zirconium oxide beads were added, and the container was sealed tight, followed by sand mill dispersion for 4 days.

The contents were filtered to remove the zirconium oxide beads. After the resulting dispersed dye was kept standing for 3 hours at room temperature, particles having a large size were removed by decantation. A dispersed dye having an average particle size of 0.2 μm was thus obtained.

| Backing layer coating solution | |
|---|---|
| Gelatin | 1.0 g/m$^2$ |
| Compound (j) | 80 mg/m$^2$ |
| Compound (k) | 15 mg/m$^2$ |
| Compound (l) | 150 mg/m$^2$ |
| Calcium chloride | 0.3 mg/m$^2$ |
| Saponin (20%) | 0.6 ml/m$^2$ |
| Citric acid | Amount required to obtain pH 5.5 |
| Latex (m) | 300 mg/m$^2$ |
| 5-methylbenzotriazole | 10 mg/m$^2$ |
| 5-nitroindazole | 20 mg/m$^2$ |
| Polyethylene glycol (molecular weight 1540) | 10 mg/m$^2$ |
| Styrene-maleic acid copolymer (thickener) | 45 mg/m$^2$ |
| Glyoxal | 4 mg/m$^2$ |
| Compound (n) | 80 mg/m$^2$ |
| Backing protective layer coating solution | |
| Gelatin | 1.18 g/m$^2$ |
| Compound (g) (1%) | 2 ml/m$^2$ |

-continued

| | |
|---|---|
| Compound (j) | 20 mg/m$^2$ |
| Compound (k) | 4 mg/m$^2$ |
| Compound (l) | 50 mg/m$^2$ |
| Spherical polymethyl methacrylate (4$\mu$) | 25 mg/m$^2$ |
| Sodium chloride | 70 mg/m$^2$ |
| Compound (g) | 1 mg/m$^2$ |
| Glyoxal | 22 mg/m$^2$ |
| Bisvinylsulfonylmethyl ether | 5 mg/m$^2$ |

(g)

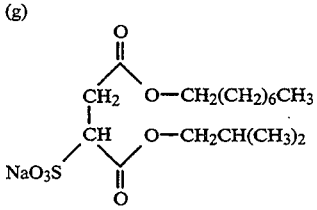

(h)

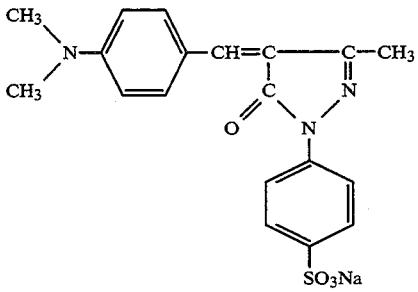

(i)

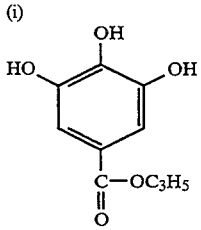

(j)

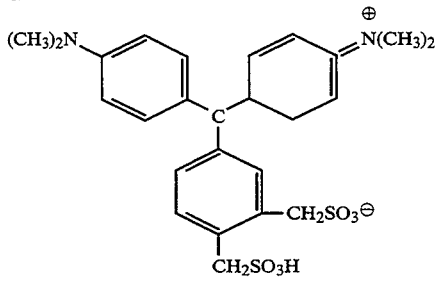

-continued (k)

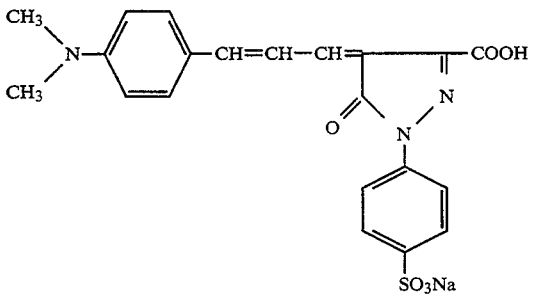

(l)

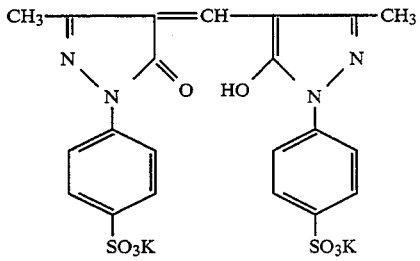

(m)

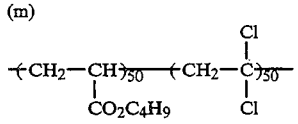

(n)

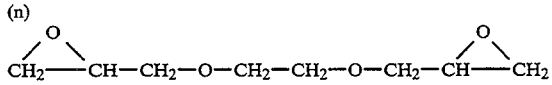

After the emulsion coating face of a polyethylene terephthalate base of 100 $\mu$m thickness was subbed as described in Japanese Patent O.P.I. Publication No. 19941/1984 and the opposite face was subjected to corona discharge at 10 W/(m$^2$.min), the following composition was coated to a coating amount of 10 cc/m$^2$, using a roll fit coating pan and an air knife.

Drying was carried out in a parallel stream of hot blow at 90° C. for 30 seconds and subsequently at 140° C. for 90 seconds with an overall coefficient of heat transfer of 25 kcal(m$^2$.hr.°C.). After drying, the layer had a thickness of 1 $\mu$m and a surface resistivity of $1\times10^8$ $\Omega$ at 23° C. and 55% RH.

| | |
|---|---|
| Water soluble electroconductive polymer | 70 g/l |

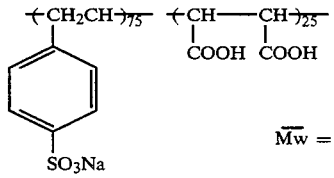

$\overline{Mw}$ = 5000

| | |
|---|---|
| Hydrophobic polymer particle | 40 g/l |

-continued

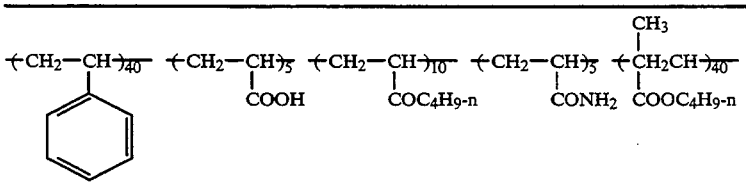

| | |
|---|---|
| Ammonium sulfate | 0.5 g/l |
| Polyethylene oxide compound (average molecular weight 600) | 6 g/l |
| Hardener | 12 g/l |

Mixture of

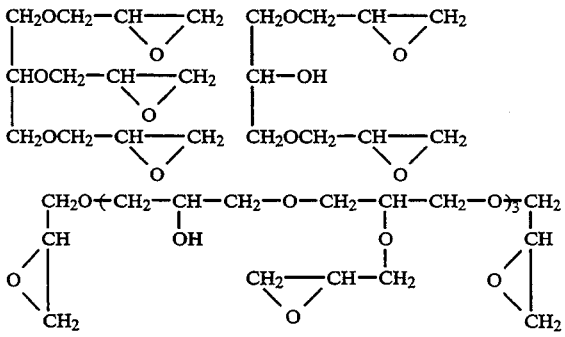

This base was coated with an emulsion layer and an emulsion protective layer in this order from the support side by the simultaneous coating method, while maintaining a temperature of 35° C. and adding a hardener solution by the slide hopper method. After the base was passed through a cold air setting zone (5° C.), a backing layer and a backing protective layer were coated, while adding a hardener solution using a slide hopper, followed by cold air setting (5° C). At each time point of passage through each setting zone, the coating solution set well. Subsequently, both faces were simultaneously dried in a drying zone under the following conditions.

During the period from coating both backing layers to winding, the light-sensitive material was transported without being in contact with the roller etc. , the coating speed being 120 m/min.

Drying conditions

After setting, the light-sensitive material was dried with 30° C. dry air blow until the water/gelatin ratio by weight became 800%, then with 35° C. (30%) dry air blow when the water/gelatin ratio by weight was between 80% and 200%, followed by further air blowing until the surface temperature became 34° C. (this point is regarded as the time of completion of drying). Thirty seconds later, additional drying was conducted with 48° C., 2% air for 1 minute. Drying time was 50 seconds from initiation of drying to reach of 800% water/gelatin ratio, 35 seconds from 800% to 200%, and 5 seconds from 200% to completion of drying.

This light-sensitive material was wound up at 23° C. and 40% humidity and then cut under the same conditions. Each piece, along with a piece of thick paper previously kept at 40° C. and 10% RH for 8 hours and then at 23° C. and 40% RH for 2 hours for moisture conditioning, was then tightly packed in a barrier bag previously subjected to humidity conditioning under the same conditions as the above winding, cutting conditions for 3 hours.

The thus-prepared light-sensitive material had a silver coating amount of 3.5 g/m$^2$. It was then processed with the following processing solutions under the following conditions, using an automatic processing machine GR-27 (produced by Konica Corporation).

| Processing conditions | | |
|---|---|---|
| Process | Processing temperature | Processing time |
| Development | 28° C. | 30 seconds |
| Fixation | 28° C. | About 20 seconds |
| Washing | Normal temp. | About 20 seconds |

| Developing solution 1 | |
|---|---|
| Composition A | |
| Deionized water | 150 ml |
| Disodium ethylenediaminetetraacetate | 2 g |
| Diethylene glycol | 50 g |
| Potassium sulfite (55% w/v aqueous solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide | Amount required to obtain pH 10.4 |
| Potassium bromide | 4.5 g |
| Composition B | |
| Deionized water | 3 ml |
| Acetic acid (90% aqueous solution) | 0.3 ml |
| 5-nitroindazole | 110 mg |
| 1-phenyl-3-pyrazolidone | 500 mg |

The above compositions A and B were dissolved in 500 ml of water in this order, and water was added to make a total quantity of 1 l for the developing solution.

| | |
|---|---|
| Composition A | |
| Ammonium thiosulfate (72.5% w/v aqueous solution) | 230 ml |
| Sodium sulfite | 9.5 g |
| Sodium acetate trihydrate | 28.9 g |
| Boric acid | 6.7 g |
| Sodium citrate dihydrate | 2 g |
| Acetic acid (90% w/w aqueous solution) | 12 ml |
| Composition B | |
| Deionized water | 17 ml |
| Sulfuric acid (50% w/w aqueous solution) | 5.8 g |
| Aluminum sulfite (aqueous solution containing | 26.5 g |

-continued 8.1% w/w $Al_2O_3$)

The above compositions A and B were dissolved in 500 ml of water in this order, and water was added to make a total quantity of 1 l for the fixer. This fixer had a pH of about 4.5.

The thus-prepared light--sensitive material was evaluated as follows:

Dot quality

The sample was subjected to dot exposure to a 90% dot area and then processed. Dot quality was assessed in ten grades, grade 10 indicating the best dot quality, grade 1 indicating the worst level, grades 5 or higher indicating practically acceptable levels.

Storage stability

The sample was kept at 23° C. and 50% RH for moisture conditioning, after which it was tightly packed with its emulsion face and backing face in contact. This sample was stored at a temperature of 48° C. and a relative humidity of 20% for 6 days, after which its sensitivity, in percent ratio, was determined in comparison with the sensitivity of the sample before storage. The sensitivity is shown as a reciprocal number of exposure light value to obtain an optical ensity of 2.5.

Residual color

Test samples were developed without exposing to light, and five pieces of processed samples were piled up to evaluate by visual inspection. The most preferable sample having minimum residual color was designated to grade 10, and grade 1 indicates the worst residual color, grades 5 or higher indicate practically acceptible levels.

The results are summarized in Table 5.

TABLE 5

| Sample | Compound used | Dot quality | Storage stability, 48° C. × 6 days | Residual Color |
|---|---|---|---|---|
| Comparative 5-1 | Comparative dye 1 | 6 | 75 | 4 |
| Comparative 5-2 | Comparative dye 2 | 5 | 78 | 5 |
| Inventive 5-3 | Inventive Compound (2) | 8 | 92 | 9 |
| Inventive 5-4 | Inventive Compound (5) | 8 | 89 | 9 |
| Inventive 5-5 | Inventive Compound (71) | 8 | 90 | 9 |

Comparative dye 1

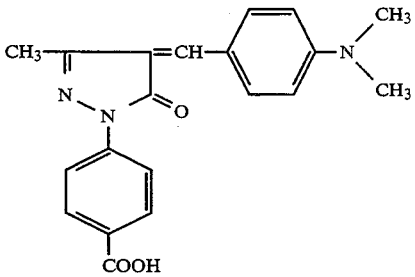

Comparative dye 2

TABLE 5-continued

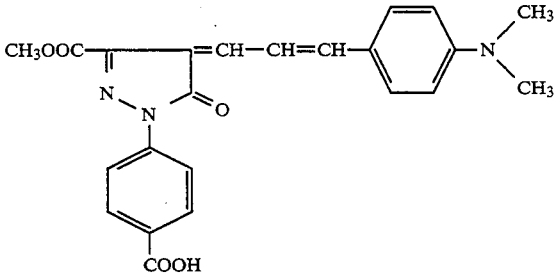

Comparative dye 3

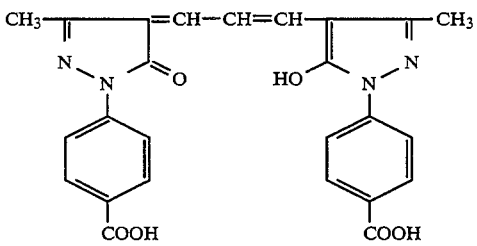

The Table 5 shows that the samples of the invention has an improved dot quality, storage stability and residual color.

EXAMPLE 6

Extra high contrast light sensitive material were prepared using tetrazolium compounds. To the emulsion composition of the Example 5 the following compound T-1 was added. The same evaluation was conducted. Contrast values of these samples were between 9.5 to 10.2. The results are summarized in Table 6.

TABLE 6

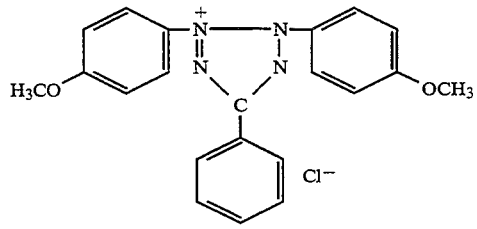

| Sample | Compound used | Dot quality | Storage stability, 48° C. × 6 days | Residual Color |
|---|---|---|---|---|
| Comparative 6-1 | Comparative dye 1 | 6 | 78 | 4 |
| Comparative 6-2 | Comparative dye 2 | 6 | 79 | 5 |
| Inventive 6-3 | Inventive Compound (2) | 9 | 93 | 9 |
| Inventive 6-4 | Inventive Compound (5) | 8 | 90 | 9 |
| Inventive 6-5 | Inventive Compound (71) | 8 | 90 | 9 |

The Table 5 shows that the samples of the invention has an improved dot quality, storage stability and residual color.

EXAMPLE 7

Light sensitive material which are suitable for super rapid processing were prepared. Samples of Example 6 were modified by adding thereto a compound shown in Table 7, the gelatin amount was changed in the following list and the dynamic surface tension was adjusted as shown in the list. Each layer were coated by means of a simultaneous multiple curtain coating at 400 m/min.

| Layer | Gelatin amount ($g/m^2$) | Dynamic surface tension(dyne/$cm^2$) |
|---|---|---|
| Emulsion | 0.8 | 13 |
| Emulsion Protect | 0.9 | 19 |
| Backing | 1.2 | 16 |
| Backing protect | 0.8 | 23 |

The resulted samples were processed in the same as in Example 5 but the processing condition was modified as below.

| Process | (Processing Condition) Temperature | Time (seconds) |
|---|---|---|
| Development | 34 | 10 |
| Fix | 34 | 6 |
| Wash | Normal temp. | 6 |
| Drying | 40 | 12 |

The resulted contreast were between 9.3 and 11.0. The rsults are summarized in Table 7.

TABLE 7

| Sample | Compound used | Dot quality | Storage stability, 48° C. × 6 days | Residual Color |
|---|---|---|---|---|
| Comparative 7-1 | Comparative dye 1 | 6 | 77 | 5 |
| Comparative 7-2 | Comparative dye 2 | 6 | 76 | 5 |
| Inventive 7-3 | Inventive Compound (5) | 9 | 93 | 8 |
| Inventive 7-4 | Inventive Compound (12) | 8 | 94 | 9 |
| Inventive 7-5 | Inventive Compound (16) | 8 | 94 | 8 |

Table 7 shows that the samples of the invention has an improved dot quality, storage stability and residual color.

EXAMPLE 8

Using a hydrazine derivative, a light-sensitive material offering very high contrast was prepared as follows:

Preparation of emulsion

Solution I: 600 ml of water, 18 g of gelatin, pH 3.0.
Solution II: 200 g of $AgNO_2$, 800 ml of water.
Solution III: 1.4 g of KBr, 76 g of NaCl, 4 mg of $(NH_4)_3RhCl_6$, 800 ml of water.

Using the above solutions I, II and III, emulsion B was prepared as follows:

Emulsion B (Br content 1 mol %, grain size 0.20 μm, Rh $1.0\times10^{-5}$ mol/mol Ag)

While keeping solution I at 40° C., solutions II and III were added at constant rate over a 20-minute period by the double jet method. After soluble salts were removed from this emulsion, gelatin was added. Then, without chemical sensitization, 6-methyl-4-hydroxy-1,3,3a,7-tetrazaindene was added. With this emulsion, the average grain size was 0.20 mm, the yield was 1 kg, and the gelatin content was 60 g.

After the following amounts of the following compounds H-1 and H-2 were added, 1-phenyl-5-mercaptotetrazole ($2\times10^{-4}$ ml/mol silver) and polyethyl acrylate latex (30 wt. % solid content relative to gelatin) was added, and 1,3-vinylsulfonyl-2-propanol (150 $mg/m^2$), as a hardener, was added, to yield a silver halide emulsion layer coating solution.

This silver halide emulsion layer coating solution and other coating solutions of the following compositions were coated and dried on a polyethylene terephthalate film support containing 100 $mg/m^2$ $SnO_2/Sb$ in the order of an anti-halation layer, a silver halide emulsion layer (3.8 $g/m^2$ silver coated), a lower protective layer and an upper protective layer from the support side on the subbing layer opposite to the backing layer, and in the order of a backing layer and a backing protective layer from the support side on the backing layer side. The inventive compounds listed in Table 8 were dispersed in the same manner as in Example 5.

| | |
|---|---|
| Anti-halation layer | |
| Gelatin | 0.6 $g/m^2$ |
| 1,3-vinylsulfonyl-2-propanol | 80 $mg/m^2$ |
| Sodium dodecylbenzenesulfonate | 15 $mg/m^2$ |
| Inventive compound | See Table 8 |
| Uppermost protective layer | |
| Gelatin | 0.6 $g/m^2$ |
| Polymethyl methacrylate micrograins (average grain size 2.5 μm) | 20 $mg/m^2$ |
| Silicon dioxide micrograins (average grain size 2.8 μm) | 30 $mg/m^2$ |
| Potassium salt of N-perfluorooctanesulfonyl-N-propyleneglycine | 3 $mg/m^2$ |
| Sodium dodecylbenzenesulfonate | 20 $mg/m^2$ |
| Lower protective layer | |
| Gelatin | 1 $g/m^2$ |
| Thioctic acid | 6 $mg/m^2$ |
| Compound (g) | 100 $mg/m^2$ |
| 1,5-dihydroxy-2-benzaldoxime | 35 $mg/m^2$ |
| Sodium dodecylbenzenesulfonate | 10 $mg/m^2$ |
| Backing layer | |
| Gelatin | 2.5 $g/m^2$ |
| Compound (l) | 0.26 $mg/m^2$ |
| Compound (o) | 30 $mg/m^2$ |
| Compound (p) | 40 $mg/m^2$ |
| Compound (h) | 90 $mg/m^2$ |
| Sodium di-2-ethylhexyl-sulfosuccinate | 30 $mg/m^2$ |

-continued

| | |
|---|---|
| Sodium dodecylbenzenesulfonate | 35 mg/m$^2$ |
| 1,3-divinylsulfonyl-2-propanol | 130 mg/m$^2$ |
| Ethyl acrylate latex (average particle size 0.05μ) | 0.5 g/m$^2$ |
| Backing protective layer | |
| Gelatin | 0.8 g/m$^2$ |
| Polymethyl methacrylate micrograins (average grain size 3.4μ) | 40 mg/m$^2$ |
| Sodium di-2-ethylhexyl-sulfosuccinate | 9 mg/m$^2$ |
| Sodium dodecylbenzenesulfonate | 10 mg/m$^2$ |
| Sodium acetate | 40 mg/m$^2$ |

(H-1)

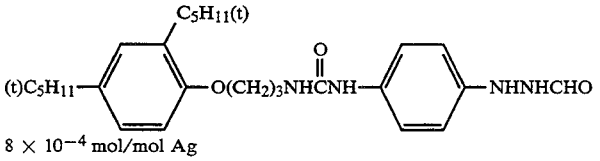

$8 \times 10^{-4}$ mol/mol Ag (H-2)

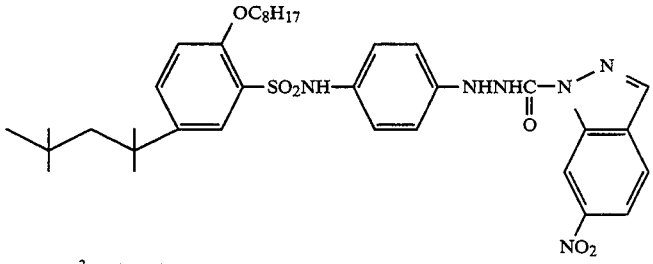

$8 \times 10^{-3}$ mol/mol Ag

Compound (o)

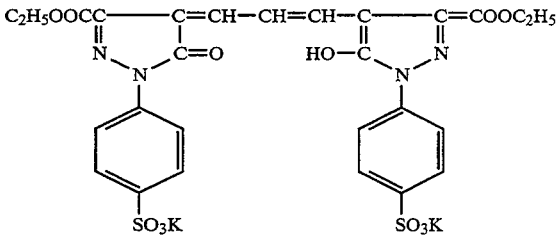

Compound (p)

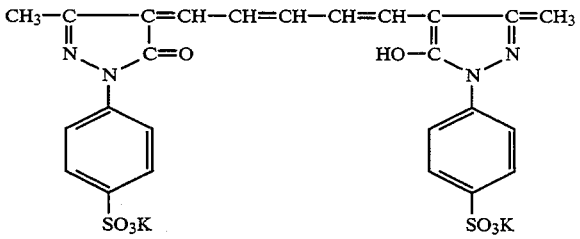

Compound (q)

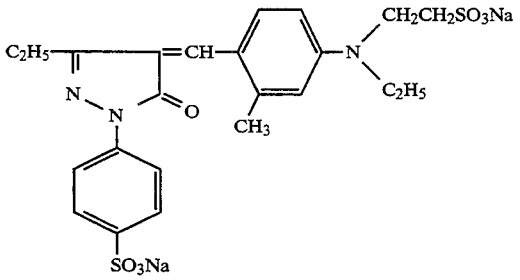

The obtained photographic light-sensitive material was evaluated in the same manner as in Example 5 after development with the following developer at 38° C. for 15 seconds and subsequent fixation and washing, using an automatic processing machine for printing GQ-26SR (produced by Konica Corporation). The results are given in Table 8.

| Developer | |
|---|---|
| Hydroquinone | 50.0 g |
| N-methyl-p-aminophenol | 0.3 g |
| Sodium hydroxide | 18.0 g |
| 5-sulfosalicylic acid | 30.0 g |
| Boric acid | 20.0 g |
| Potassium sulfite | 110.0 g |
| Disodium ethylenediaminetetraacetate | 1.0 g |
| Potassium bromide | 10.0 g |
| 5-methylbenzotriazole | 0.4 g |
| 2-mercaptobenzimidazole-5-sulfonic acid | 0.3 g |
| Sodium 3-(5-mercaptotetrazole)benzenesulfonate | 0.2 g |
| 6-dimethylamino-1-hexanol | 4.0 g |
| Sodium toluenesulfonate | 15.0 g |

Water was added to make a total quantity of 1 l, and sodium hydroxide was added to obtain a pH of 11.7.

TABLE 8

| Sample | Anti-hallation layer Compound used | Anti-hallation layer Amount (mg/m²) | Emulsion protect layer Compound used | Emulsion protect layer Amount (mg/m²) | Dot quality | Storage stability, 48° C. × 6 days | Residual Color |
|---|---|---|---|---|---|---|---|
| Comparative 8-1 | Comparative dye 1 | 86 | — | — | 6 | 76 | 5 |
| Comparative 8-2 | Comparative dye 2 | 86 | — | — | 5 | 75 | 4 |
| Comparative 8-3 | Comparative dye 2 | 43 | Compound (h) | 40 | 5 | 72 | 5 |
| Inventive 8-4 | Inventive Compound (3) | 86 | — | — | 8 | 91 | 8 |
| Inventive 8-5 | Inventive Compound (5) | 86 | — | — | 8 | 93 | 9 |
| Inventive 8-6 | Inventive Compound (30) | 86 | — | — | 8 | 90 | 9 |
| Inventive 8-7 | Inventive Compound (53) | 86 | — | — | 8 | 89 | 8 |
| Inventive 8-8 | Inventive Compound (5) | 43 | Compound (h) | 40 | 7 | 87 | 8 |
| Inventive 8-9 | Inventive Compound (3) | 43 | Inventive Compound (3) | 40 | 9 | 92 | 8 |
| Inventive 8-10 | Inventive Comound (5) | 43 | Inventive Comound (5) | 40 | 8 | 93 | 9 |
| Inventive 8-11 | Inventive Compound (30 | 43 | Inventive Compound (30) | 40 | 9 | 93 | 9 |
| Inventive 8-12 | Inventive Compound (53) | 43 | Inventive Compound (5) | 40 | 9 | 91 | 8 |

From Table 8, it is seen that the photographic light-sensitive material according to the present invention offers improvements in residual color staining, storage stability and dot quality.

EXAMPLE 9

Preparation of silver halide photographic emulsion C

A silver chlorobromide emulsion containing 65 mol % silver chloride per mol silver was prepared by the double jet method. At this mixing, $8\times10^{-7}$ mol of $K_2IrCl_6$ and $1\times10^{-7}$ mol of $Na_2RhCl_6$, both per mol of silver, were added. The obtained emulsion comprised monodispersed cubic grains having an average grain size of 0.20 μm and a coefficient of variance of 10%.

After this emulsion was washed and desalinized by conventional methods, a mixture of the following compounds A, B and C was added, after which the emulsion was subjected to gold-sulfur sensitization to yield emulsion C.

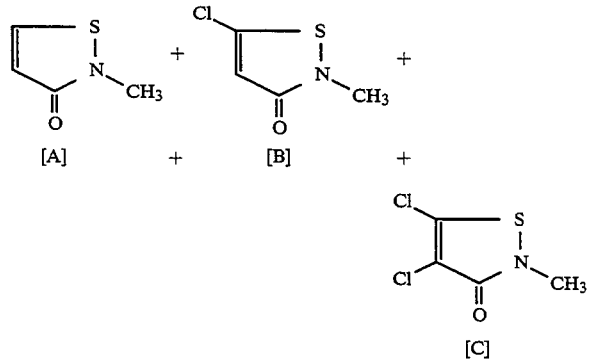

Preparation of silver halide photographic light-sensitive material

On one subbing layer of a polyethylene terephthalate film of 100 μm thickness, subbed with a 0.1 μm subbing layer (see Example 1 of Japanese Patent O.P.I Publication No. 19941/1984) on both faces, a silver halide emulsion layer of the following composition 1 was coated so that the amounts of gelatin and silver coated would be 1.5 g/m² and 3.2 g/m², respectively, followed by coating an emulsion-protective layer of the following composition 2 so that the amount of gelatin coated would be 1.0 g/m². On the other subbing layer was coated a backing layer of the following composition 3 so that the amount of gelatin coated would be 2.4 g/m², followed by coating of a backing protective layer of the following composition 4 so that the amount of gelatin coated would 1 g/m². A silver halide photographic light-sensitive material sample was thus obtained.

| Composition 1 (silver halide emulsion layer (i) | |
|---|---|
| Gelatin | Equivalent to 1.5 g/m² in the emulsion layer |
| Silver halide emulsion C (amount of silver) | 3.2 g/m² |
| Sensitizing dye SD-1 | 10 mg/m² |
| Sensitizing dye SD-2 | 3 mg/m² |

-continued

| | |
|---|---|
| Stabilizer 4-methyl-6-hydroxy-1,3,3a,7-tetrazaindene | 30 mg/m$^2$ |
| Antifogging agent adenine | 10 mg/m$^2$ |
| Antifogging agent sodium 2-mercapto-benzimidazole-5-sulfonate | 5 mg/m$^2$ |
| Surfactant saponin | 0.1 g/m$^2$ |
| Surfactant S-1 | 8.0 mg/m$^2$ |
| Hydrazine derivative H-1 | 10 mg/m$^2$ |
| Hydrazine derivative H-2 | 2 mg/m$^2$ |
| Nucleation accelerator N | 50 mg/m$^2$ |
| Polyethylene glycol (molecular weight 4000) | 0.1 g/m$^2$ |
| Sensitizing dye SD-1 | 10 mg/m$^2$ |

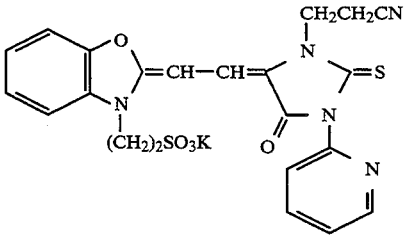

Sensitizing dye SD-2 3 mg/m$^2$

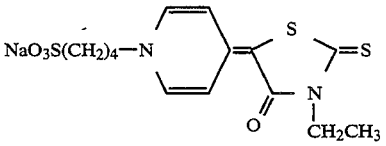

Surfactant S-1

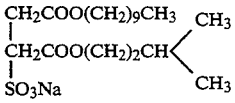

N

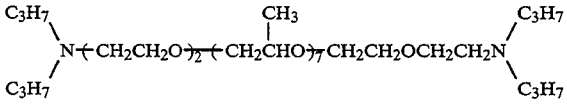

Composition 2 (emulsion protective layer composition)

| | |
|---|---|
| Gelatin | 0.9 g/m$^2$ |
| Surfactant S-2 | 10 g/m$^2$ |

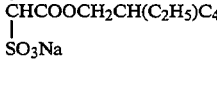

Surfactant S-3 5 mg/m$^2$

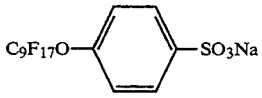

| | |
|---|---|
| Compound (Dipersion of solid fine particles of dye shown in Table 4, in an amount as a solid dye)) | 90 mg/m$^2$ |
| Matting agent monodispersed silica grains having an average grain size 3.5 μm | 10 mg/m$^2$ |
| Hardener 1,3-vinylsulfonyl-2-propanol | 40 mg/m$^2$ |

Solid particle dispersions of the dyes shown in Tables 9 were prepared by dispersing respective compounds into solid particle in a ball mill as described in Example 5.

Composition 3 (backing layer composition)

(o) 70 mg/m$^2$

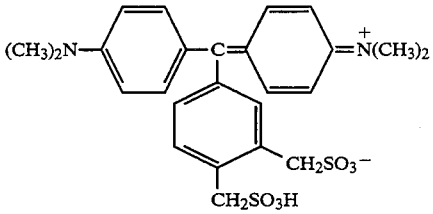

(p) 50 mg/m$^2$

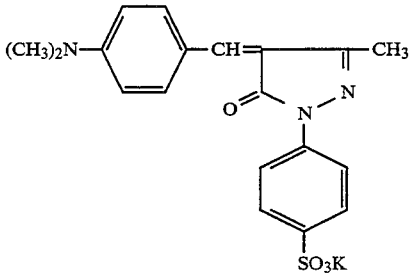

(q) 20 mg/m$^2$

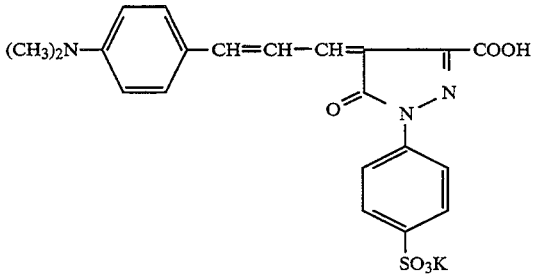

| | |
|---|---|
| Gelatin | 2.4 g/m$^2$ |
| Surfactant saponin | 0.1 g/m$^2$ |
| Surfactant S-1 | 6 mg/m$^2$ |
| Colloidal silica | 100 mg/m$^2$ |

Composition 4
(backing protective layer composition)

| | |
|---|---|
| Gelatin | 1 g/m$^2$ |
| Matting agent monodispersed polymethyl methyacrylate having an average grain size of 3.5 μm | 40 mg/m$^2$ |
| Surfactant S-2 | 10 mg/m$^2$ |
| Hardener glyoxal | 35 mg/m$^2$ |

This sample was then processed with the developer of Example 8 and the following fixer under the following conditions, u sing an automatic processing machine for printing GQ-26SR (produced by Konica Corporation).

| Fixer | |
|---|---|
| Composition A | |
| Ammonium thiosulfate (72.5% w/v aqueous solution) | 230 ml |
| Sodium sulfite | 9.5 g |
| Sodium acetate trihydrate | 28 g |
| Boric acid | 6.7 g |
| Sodium citrate dihydrate | 2 g |
| Acetic acid (90% w/w aqueous solution) Amount required to obtain a solution pH of 4.7 | |
| Composition B | |
| Water | 17 ml |

-continued

| Fixer | |
|---|---|
| Sulfuric acid (50% w/w aqueous solution) | 2.5 g |
| Aluminum sulfate (aqueous solution containing 8.1% w/w $Al_2O_3$) | 21 g |

The above compositions A and B were dissolved in 500 ml of water in this order, and water was added to make a total quantity of 1 l for the fixer.

| Process | Processing conditions: Processing temperature | Processing time |
|---|---|---|
| Development | 38° C. | 12 seconds |
| Fixation | 35° C. | 10 seconds |
| Washing | Normal temp. | 10 seconds |
| Drying | 50° C. | 13 seconds |
| Total | — | 45 seconds |

Each processing time includes so-called transition time to the next process. 30 $m^2$ of the sample was processed, while supplying a developer replenisher at 160 cc/$m^2$ and a fixer replenisher at 190 cc/$m^2$. The developer replenisher and fixer replenisher had the same compositions as the developer and fixer, respectively. The processed sample was evaluated in the same manner as in Example 5. The results are given in Table 9.

TABLE 9

| Sample | Compound used | Dot quality | Storage stability, 48° C. × 6 days | Residual Color |
|---|---|---|---|---|
| Comparative 9-1 | Comparative dye 2 | 6 | 77 | 5 |
| Comparative 9-2 | Comparative dye 3 | 6 | 78 | 4 |
| Inventive 9-3 | Inventive Compound (12) | 9 | 95 | 9 |
| Inventive 9-4 | Inventive Compound (19) | 8 | 94 | 9 |
| Inventive 9-5 | Inventive Compound (55) | 9 | 93 | 8 |

From Table 9, it is seen that the photographic light-sensitive material of the present invention offers improvements in residual color staining, storage stability and dot quality.

EXAMPLE 10

On one face of a subbed polyethylene terephthalate film as described in Example 1 of Japanese Patent O.P.I. Publication No. 19941/1984, an anti-halation layer, a silver halide emulsion (iii) layer and a protective layer, arranged in this order from the subbing layer side, were simultaneously coated to yield sample Nos. 10-1 through 10-18.

Solid particle dispersions of the dyes shown in Table 10 were prepared by dispersing respective compounds into solid particle in a ball mill as described in Example 5.

| Anti-halation layer | |
|---|---|
| Gelatin | 1.0 g/$m^2$ |
| Polymer (2) | 0.1 g/$m^2$ |
| Sodium p-dodecylbenzenesulfonate | 10 mg/$m^2$ |
| Inventive compound | See Table 10 |
| Hardener (shown below) | 50 mg/$m^2$ |
| Polymer (2) | |

-continued

Anti-halation layer

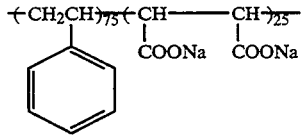

MW = 5000

Hardener $[CH_2{=}CHSO_2CH_2CONHCH_2]_2$

Preparation of silver halide emulsions E and F

Using the following solutions A, B and C, silver halide emulsions were prepared.

| | |
|---|---|
| Solution A | |
| Ossein gelatin | 17 g |
| Polyisopropylene-sodium polyethyleneoxydisuccinate in 10% aqueous ethanol solution | 5 ml |
| Distilled water | 12800 ml |
| Solution B | |
| Silver nitrate | 170 g |
| Distilled water | 410 ml |
| Solution C | |
| Sodium chloride | 45.0 g |
| Potassium bromide | 27.4 g |
| Rhodium trichloride trihydrate | 28 μm |
| Sodium polyisopropyleneoxydisuccinate in 10% aqueous ethanol solution | 3 ml |
| Ossein gelatin | 11 g |
| Distilled water | 407 ml |

While keeping solution A at 40° C., sodium chloride was added to an EAg value of 160 mV.

Solutions B and C were added by the double jet method, using the mechanical mixer-stirrer described in Japanese Patent O.P.I. Publication Nos. 92523/1982 and 92524/1982.

The rate of addition was gradually increased over a total addition time of 80 minutes, while keeping the EAg value at 160 mV initially and then at 120 mV obtained with a 3 ml/l aqueous sodium chloride solution added 5 minutes after initiation of addition, which level was maintained until completion of mixing.

To keep the EAg value constant, a 3 mol/l aqueous sodium chloride solution was used.

EAg values were determined using a metal electrode and a double-junction type saturated Ag/AgCl reference electrode (the electrode configuration was the double junction disclosed in Japanese Patent O.P.I. Publication No. 197534/1982). Solutions B and C were added, using a flow-rate-variable roller tube constant discharge pump, while electron microscopically confirming the absence of newly formed grains in the system via emulsion sampling. During the addition, a 3% aqueous nitric acid solution was added to keep system pH at 3.0.

After completion of the addition of solutions B and C, Ostwald ripening was conducted for 10 minutes, followed by conventional desalinization and washing. Then 600 ml of an aqueous ossein gelatin solution (30 g ossein gelatin contained) was added, followed by stirring dispersion at 55° C. for 30 minutes. After water was added to make a total quantity of 750 ml, the dispersion was subjected to gold-sulfur sensitization to yield emulsion E. And, 10 mg/mol silver N,N-dimethylselenourea was added at the time of gold-sulfur sensitization. The resulting emulsion was designated as emulsion F.

Silver halide emulsion layer (iii) (3.7 g/m$^2$ silver coated)

To each of silver halide emulsions E and F was added 4-hydroxy-6-methyl-1,3,3a,11-tetrazaindene. Then, SD-1 of Example 9 at 300 mg per mol silver halide, SD-2 of Example 9 at 100 mg per mol silver halide and the following compounds were added to yield a coating solution.

| | |
|---|---|
| Compound T-1 | 620 mg |
| Sodium p-dodecylbenzenesulfonate | 300 mg |
| Styrene-maleic acid copolymer | 2 g |
| Styrene-butyl acrylate-acrylic acid copolymer latex (average grain size about 0.25 μm) | 1.5 g |
| Protective layer | |
| Gelatin | 0.7 g/m$^2$ |
| Inventive compound | See Table 10 |
| Sodium-di(2-ethylhexyl)-sulfosuccinate | 10 mg/m$^2$ |
| Formalin | 15 mg/m$^2$ |
| Glyoxal | 8 mg/m$^2$ |

The sample was processed with the same processing solutions as in Example 5 under the following conditions:

| Process | Processing conditions: Processing temperature | Processing time | Tank capacity |
|---|---|---|---|
| Development | 35° C. | 14 seconds | 20 l |
| Fixation | 34° C. | 13 seconds | 20 l |
| Washing | 18° C. | 8 seconds | 15 l |
| Drying | 50° C. | 7 seconds | — |

Each processing time includes so-called transition time to the next process. Processing was conducted on a dry-to-dry basis for 42 seconds.

The washing water contained 4.9 ppm calcium ions.

The dot-to-dot enlargement performance in the Table was evaluated by rating the image quality in the shadow portion in ten grades at a constant level of percent dot density in the highlighted portion as adjusted by exposure amount, grade 10 indicating the best, grade 1 indicating the worst.

After a total of 150 m$^2$ of a silver halide photographic light-sensitive material of 80% developed silver, residual color staining was evaluated in the same manner as in Example 5. Storage stability was evaluated in the same manner as in Example 9. The results are given in Tables 10.

TABLE 10

| Sample | Anti-hallation layer: Compound used | Anti-hallation layer: Amount (mg/m$^2$) | Emulsion protect layer: Compound used | Emulsion protect layer: Amount (mg/m$^2$) | Emulsion | Dot-to-dot enlargement | Storage stability 48° C. × 6 days | Residual Color: Instant | Residual Color: After running |
|---|---|---|---|---|---|---|---|---|---|
| Comparative 10-1 | Comparative dye 2 | 90 | — | — | E | 6 | 77 | 6 | 4 |
| Comparative 10-2 | Comparative dye 3 | 90 | — | — | E | 6 | 78 | 6 | 4.5 |
| Comparative 10-3 | Comparative dye 3 | 90 | Compound (h) | 45 | E | 6 | 77 | 6 | 4 |
| Inventive 10-4 | Inventive Compound (3) | 90 | — | — | E | 8 | 94 | 8 | 7.5 |
| Inventive 10-5 | Inventive Compound (5) | 90 | — | — | E | 8 | 94 | 8 | 7.5 |
| Inventive 10-6 | Inventive Compound (16) | 90 | — | — | E | 8 | 95 | 9 | 8.5 |
| Inventive 10-7 | Inventive Compound (21) | 90 | — | — | E | 8 | 95 | 9 | 8.5 |
| Inventive 10-8 | Inventive Compound (30) | 90 | — | — | E | 8 | 93 | 9 | 8.5 |
| Inventive 10-9 | Inventive Compound (31) | 90 | — | — | E | 8 | 93 | 9 | 8.5 |
| Inventive 10-10 | Inventive Compound (55) | 90 | — | — | E | 8 | 90 | 8 | 7.0 |
| Inventive 10-11 | Inventive Compound (71) | 90 | — | — | E | 8 | 92 | 9 | 8.5 |
| Inventive 10-12 | Inventive Compound (5) | 90 | Inventive Compound (14) | 45 | E | 9 | 95 | 9 | 8.5 |
| Inventive 10-13 | Inventive Compound (71) | 90 | Inventive Compound (14) | 45 | E | 8 | 93 | 8 | 7.5 |
| Inventive 10-14 | Inventive Compound (5) | 90 | Compound (h) | 45 | E | 8 | 91 | 8 | 7.5 |
| Inventive 10-15 | Inventive Compound (71) | 90 | Compound (h) | 45 | E | 8 | 92 | 9 | 8.5 |
| Inventive 10-16 | Inventive Compound (5) | 90 | — | — | F | 9 | 92 | 8 | 8.5 |
| Inventive 10-17 | Inventive Compound (71) | 90 | — | — | F | 8 | 93 | 8 | 7.5 |
| Inventive 10-18 | Inventive Compound (5) | 90 | Compound (h) | 45 | F | 8 | 93 | 8 | 7.5 |

From Tables 10, it is seen that the constitution of the present invention offers improvements in sharpness, storage stability and residual color staining.

EXAMPLE 11

Preparation of orthochromatic light-sensitive material for radiography

A silver halide emulsion was prepared by the method described in Examples of Japanese Patent O.P.I. Publication No. 110453/1990 and subjected to gold-sulfur sensitization described below, after which it was spectrally sensitized with 5,5'-dichloro-9-ethyl-3,3'-di(d-sulfopropyl)-oxacarbocyanine sodium salt and subsequently stabilized with 4-hydroxy-6-methyl-1,3,3a,11-tetrazaindene. This emulsion, the following crossover cut layer and the following protective layer were coated on both faces of a blue-colored polyethylene terephthalate support of 175 μm thickness, to yield a sample.

| Layer 1 (crossover cut layer) | |
|---|---|
| Inventive compound | See Table 11 |
| Gelatin | 0.75 g/m$^2$ |
| Latex LX-A (the same as in Example 5) | 0.55 g/m$^2$ |

Layer 2 (emulsion layer)

To an emulsion comprising tabular grains, previously subjected to gold-sulfur sensitization with 8.2 mg of hypo, 163 mg of KSCN and 5.4 g of chloroauric acid, all per mol silver, the following additives were added. This emulsion was coated so that the amount of silver coated would be 3.0 g/m$^2$.

| | |
|---|---|
| Spectral sensitizing dye | 63 mg/m$^2$ |
| Stabilizer | 58 mg/m$^2$ |
| Gelatin | 2.1 g/m$^2$ |
| Layer 3 (protective layer) | |
| Gelatin | 0.8 g/m$^2$ |
| PMMA matting agent (average grain size 3.5 μm) | 0.025 g/m$^2$ |

Solid particle dispersions of the dyes shown in Table 11 were prepared by dispersing respective compounds into solid particle in a ball mill as follows: To the ball mill container were added water and surfactant Alkanol XC (alkylnaphthalene sulfonate, produced by Du-Pont). After each dye was added, zirconium oxide beads were added, and the container was sealed tight, followed by ball mill dispersion for 8 days.

Evaluation of storage stability

The obtained sample was kept standing at 23° C. and 50% RH for moisture conditioning and then packed in a tight container. This sample was stored at 48° C. and 20% RH for 6 days, and percent sensitivity relative to the sensitivity of the sample before storage. Exposure was conducted with green light for 0.1 second. Sensitivity was expressed as the reciprocal of the exposure amount providing a density equivalent to (fogging+1.0).

MTF was evaluated in the same manner as in Example 4.

| Developer composition | |
|---|---|
| 1-phenyl-3-pyrazolidone | 1.5 g |
| hydroquinone | 30 g |
| 5-nitroindazole | 0.250 g |
| 5-methylbenzotriazole | 0.06 g |
| Potassium bromide | 3.0 g |
| Sodium sulfite | 50 g |
| Potassium hydroxide | 30 g |
| Boric acid | 10 g |

Water was added to make a total quantity of 1 l (pH was adjusted to 10.2).

| Fixer composition | |
|---|---|
| Ammonium thiosulfate | 200 g |
| Anhydrous sodium sulfite | 20 g |
| Boric acid | 8 g |
| Disodium ethylenediaminetetraacetate | 20 g |
| Aluminum sulfate | 15 g |
| Sulfuric acid | 2 g |
| Glacial acetic acid | 22 g |

Water was added to make a total quantity of 1 l (pH was adjusted to 5.2).

The entire course of processing was finished in 90 seconds.

The results are given in Table 11 below.

TABLE 11

| | The first layer (Side A) | | The first layer (Side B) | | Storage stability | |
|---|---|---|---|---|---|---|
| Sample | Compound used | Amount (mg/m$^2$) | Compound used | Amount (mg/m$^2$) | 48° C. × 6 days | MTF |
| Comparative 11-1 | Comparative dye 1 | 60 | Comparative dye 1 | 60 | 72 | 0.54 |
| Comparative 11-2 | Comparative dye 2 | 60 | Comparative dye 2 | 60 | 73 | 0.54 |
| Inventive 11-3 | Inventive Compound (1) | 60 | Inventive Compound (1) | 60 | 85 | 0.58 |
| Inventive 11-4 | Inventive Compound (3) | 60 | Inventive Compound (3) | 60 | 88 | 0.58 |
| Inventive 11-5 | Inventive Compound (3) | 120 | Inventive Compound (3) | 80 | 89 | 0.57 |
| Inventive 11-6 | Inventive Compound (5) | 60 | Inventive Compound (5) | 60 | 86 | 0.57 |
| Inventive 11-7 | Inventive Compound (20) | 60 | Inventive Compound (20) | 60 | 87 | 0.56 |
| Inventive 11-8 | Inventive Compound (20) | 60 | Inventive Compound (20) | 80 | 88 | 0.56 |

From Table 11, it is seen that the present invention offers good sharpness and storage stability.

The present invention provides a silver halide photographic light-sensitive material which causes reduced residual color staining and which has improved storage stability and excellent photographic properties.

We claim:

1. A silver halide photographic light-sensitive material having a light sensitive silver halide emulsion layer and a support wherein the silver halide photographic light-sensitive material comprises a solid particle dispersion of a compound of the formula dispersed in a layer:

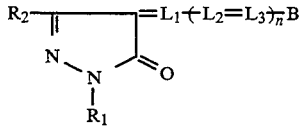

wherein the compound has at least one carboxyl group, sulfonamide group or sulfamoyl group, and $R_1$ is a hydrogen atom, an alkyl group, an aryl group or a heterocyclic group; $R_2$ is a hydrogen atom, an alkyl group, an aryl group, a heterocyclic group, an alkoxycarbonyl group, an aryloxycarbonyl group, a carbamoyl group, an acylamino group, an ureide group, an amino group, an acyl group, an alkoxy group, an aryloxy group, a hydroxyl group, a carboxyl group, a cyano group, a sulfamoyl group or a sulfonamide group; B is a 5- or 6-membered oxygen-containing heterocyclic group or a 6-membered nitrogen-containing heterocyclic group; $L_1$ through $L_3$independently represent a methine group; n represents 0 or 1.

2. A silver halide photographic light-sensitive material of claim 1 wherein the compound is represented by a formula:

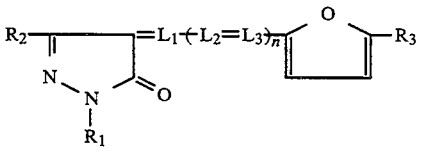

wherein $R_1$, $R_2$, $L_1$, $L_2$, $L_3$ and n are the same as defined in claim 1, and $R_3$ is an alkyl group, an aryl group, a heterocyclic group, an alkoxycarbonyl group, an aryloxycarbonyl group, a carbamoyl group, an acylamino group, an ureide group, an amino group, an acyl group, an alkoxy group, an aryloxy group, a hydroxyl group, a carboxyl group, a cyano group, a sulfamoyl group or a sulfonamide group.

3. A silver halide photographic light-sensitive material of claim 2 wherein the compound is represented by a formula:

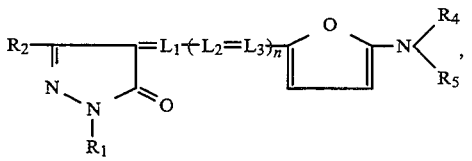

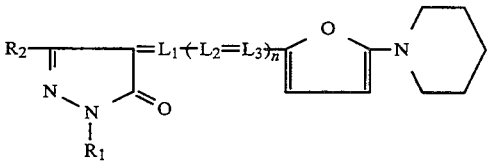

or

-continued

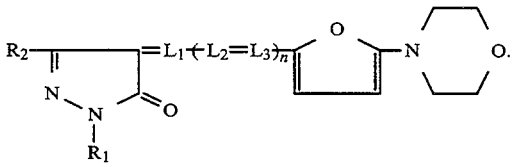

$R_1$, $R_2$, $L_1$, $L_2$, $L_3$ and n are the same as defined in claim 1, and $R_4$ and $R_5$ are a lower alkyl group.

4. A silver halide photographic light-sensitive material of claim 1 wherein the compound has a carboxyl group.

5. A silver halide photographic light-sensitive material of claim 1 wherein $R_2$ is an alkyl, aryl, alkoxycarbonyl carboxyl carbamoyl, acyl or cyano group.

6. A silver halide photographic light-sensitive material of claim 1 wherein the solid particle dispersion of a compound is comprised in a light-sensitive silver halide emulsion layer, an interlayer, a protective layer, a filter layer, an anti-halation layer, an anti-irradiation layer or a backing layer.

7. A silver halide photographic light-sensitive material of claim 1 wherein an average particle size of the solid particle dispersion is from 0.01 μm to 10 μm.

8. A silver halide photographic light-sensitive material of claim 1 wherein an average particle size of the solid particle dispersion is from 0.02 μm to 0.6 μm.

9. A silver halide photographic light-sensitive material having a light sensitive silver halide emulsion layer and a support wherein the silver halide photographic light-sensitive material comprises a solid particle dispersion of a compound of the formula dispersed in a layer.

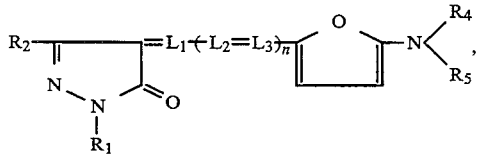

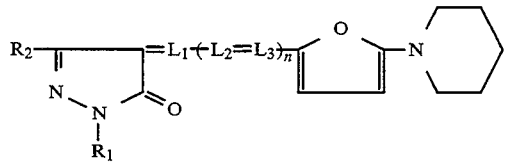

or

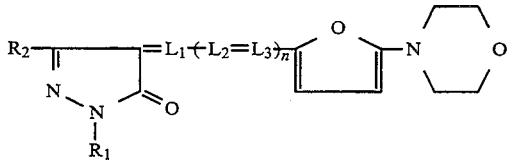

wherein the compound has at least one carboxyl group, sulfonamide group or sulfamoyl group, and $R_1$ is a hydrogen atom, an alkyl group, an aryl group or a heterocyclic group; $R_2$ is an alkyl group, an aryl group, alkoxycarbonyl group, a carboxyl group a carbamoyl group an acyl group, a cyano group; $R_4$ and $R_5$ each represent a lower alkyl group; $L_1$ through $L_3$ independently represent a methine group; n is 0 or 1.

* * * * *

UNITED STATES PATENT AND TRADEMARK OFFICE

CERTIFICATE OF CORRECTION

PATENT NO. : 5,340,707

DATED : August 23, 1994

INVENTOR(S) : Akira OHNISHI et al.

It is certified that error appears in the above-indentified patent and that said Letters Patent is hereby corrected as shown below:

Claim 1, column 87, line 27, change "$L_3$independently" to

--$L_3$ independently--.

Signed and Sealed this

Seventeenth Day of January, 1995

*Attest:*

Bruce Lehman

BRUCE LEHMAN

*Attesting Officer*

*Commissioner of Patents and Trademarks*